US008356872B2

(12) United States Patent
Ozawa et al.

(10) Patent No.: US 8,356,872 B2
(45) Date of Patent: Jan. 22, 2013

(54) LIQUID DISCHARGE APPARATUS AND METHOD

(75) Inventors: Kinya Ozawa, Shiojiri (JP); Junhua Zhang, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 244 days.

(21) Appl. No.: 12/831,354

(22) Filed: Jul. 7, 2010

(65) Prior Publication Data

US 2011/0007108 A1 Jan. 13, 2011

(30) Foreign Application Priority Data

Jul. 13, 2009 (JP) ..... 2009-164900
Mar. 16, 2010 (JP) ..... 2010-059728

(51) Int. Cl.
*B41J 29/38* (2006.01)

(52) U.S. Cl. ..... 347/14

(58) Field of Classification Search ..... 347/14, 347/10

See application file for complete search history.

(56) References Cited

U.S. PATENT DOCUMENTS

| | | | | |
|---|---|---|---|---|
| 6,412,926 | B1 * | 7/2002 | Okuda | 347/70 |
| 2002/0057303 | A1 * | 5/2002 | Takahashi et al. | 347/9 |
| 2004/0080574 | A1 | 4/2004 | Masumi | |
| 2006/0050111 | A1 * | 3/2006 | Mataki | 347/68 |
| 2009/0244128 | A1 | 10/2009 | Ozawa et al. | |

FOREIGN PATENT DOCUMENTS

| | | |
|---|---|---|
| EP | 1 900 528 A1 | 3/2008 |
| JP | 2004-090223 | 3/2004 |
| JP | 2009-255513 | 11/2009 |

* cited by examiner

*Primary Examiner* — Laura Martin
(74) *Attorney, Agent, or Firm* — Workman Nydegger

(57) ABSTRACT

A liquid discharge apparatus includes a nozzle, a pressure chamber and a liquid supply portion that supplies the liquid to the pressure chamber. A discharge pulse generating unit generates a discharge pulse to discharge the liquid. The viscosity of the liquid is no less than 8 millipascal-seconds. The nozzle has a first portion with a discharge side that has an opening area smaller than that of a pressure chamber side and a second portion that communicates with an end portion of the discharge side. An opening area of the second portion is no greater than ⅙ of the opening area of the pressure chamber side. The discharge pulse has a decompression portion that decompresses the liquid to lead a meniscus in the second portion to the first portion and a compression portion that compresses the liquid to discharge the liquid before the meniscus returns to the second portion.

8 Claims, 13 Drawing Sheets

| ANGLE / VISCOSITY | 20 | 25 | 30 | 40 |
|---|---|---|---|---|
| 8 mPas | △ (LONG TAIL) | △ (LONG TAIL) | △ (LONG TAIL) | ○ |
| 10 mPas | △ (LONG TAIL) | △ (LONG TAIL) | △ (LONG TAIL) | ○ |
| 15 mPas | △ (LONG TAIL) | △ (LONG TAIL) | △ (LONG TAIL) | ○ |
| 20 mPas | × (UNABLE) | △ (LONG TAIL) | △ (LONG TAIL) | △ (LONG TAIL) |
| 30 mPas | × (UNABLE) | × (UNABLE) | × (UNABLE) | △ (LONG TAIL) |
| 40 mPas | × (UNABLE) | × (UNABLE) | × (UNABLE) | × (UNABLE) |

| ANGLE / VISCOSITY | 50 | 60 | 80 |
|---|---|---|---|
| 8 mPas | ○ | ○ | ○ |
| 10 mPas | ○ | ○ | ○ |
| 15 mPas | ○ | ○ | ○ |
| 20 mPas | ○ | ○ | ○ |
| 30 mPas | ○ | ○ | ○ |
| 40 mPas | × (UNABLE) | × (UNABLE) | △ (LONG TAIL) |

LIQUID DISCHARGE APPARATUS AND METHOD

The entire disclosure of Japanese Patent Application Nos.: 2009-164900, filed Jul. 13, 2009 and 2010-059728, filed Mar. 16, 2010 are expressly incorporated by reference herein.

BACKGROUND

1. Technical Field

The present invention relates to a liquid discharge apparatus and method.

2. Related Art

Attempts to discharge liquid that has a higher viscosity than that of typically used aqueous ink (for convenience, also referred to as "high-viscosity liquid") through an application of ink jet printer technology have been made. For example, an apparatus, in which a nozzle for discharging liquid is composed of a tapered portion that tapers off toward a ink discharge side and a straight portion that is continuously installed from a tip end portion of the discharge side in the tapered portion, has been proposed (for example, see JP-A-2004-90223).

When high-viscosity liquid is discharged from a nozzle that is composed of a tapered portion and a straight portion, the discharge of liquid may become unstable. For example, the liquid may not be discharged, or the discharge flow rate may be insufficient. Various primary causes of unstable discharge may be considered. According to one of such causes, the pressure change that is given to liquid in a pressure chamber may not be efficiently used to discharge the liquid.

Also, when a high-viscosity liquid is discharged from a head having the shape of the related art, it can be confirmed that the discharge of the liquid becomes unstable.

SUMMARY

An advantage of some aspects of the invention is to efficiently discharge high-viscosity liquid and to stabilize the discharge operation.

According to an aspect of the invention, there is provided a liquid discharge apparatus which includes a nozzle from which liquid is discharged; a pressure chamber that gives a pressure change to the liquid in order to discharge the liquid from the nozzle; a liquid supply portion that communicates with the pressure chamber and supplies the liquid to the pressure chamber; a device that performs an operation for giving the pressure change to the liquid in the pressure chamber; and a discharge pulse generating unit that generates a discharge pulse for operating the device in order to discharge the liquid from the nozzle; wherein a viscosity of the liquid is equal to or higher than 8 millipascal seconds; the nozzle has a first portion of which a liquid discharge side has an opening area that is smaller than that of a pressure chamber side, and a second portion that communicates with an end portion of the discharge side of the first portion; an opening area of the second portion is equal to or smaller than ⅕ of the opening area of the pressure chamber side as an opening of the liquid supply portion; and the discharge pulse has a decompression portion that decompresses the liquid to lead a meniscus positioned in the second portion to the first portion, and a compression portion that compresses the liquid to discharge the liquid before the meniscus which has been led to the first portion returns to the second portion.

Other characteristics of the invention will be apparent from the description of the specification and the accompanying drawings.

BRIEF DESCRIPTION OF THE DRAWINGS

The invention will be described with reference to the accompanying drawings, wherein like numbers reference like elements.

FIG. 4 is a block diagram illustrating a configuration of a drive signal generation circuit or the like.

DESCRIPTION OF EXEMPLARY EMBODIMENTS

Figure 1:
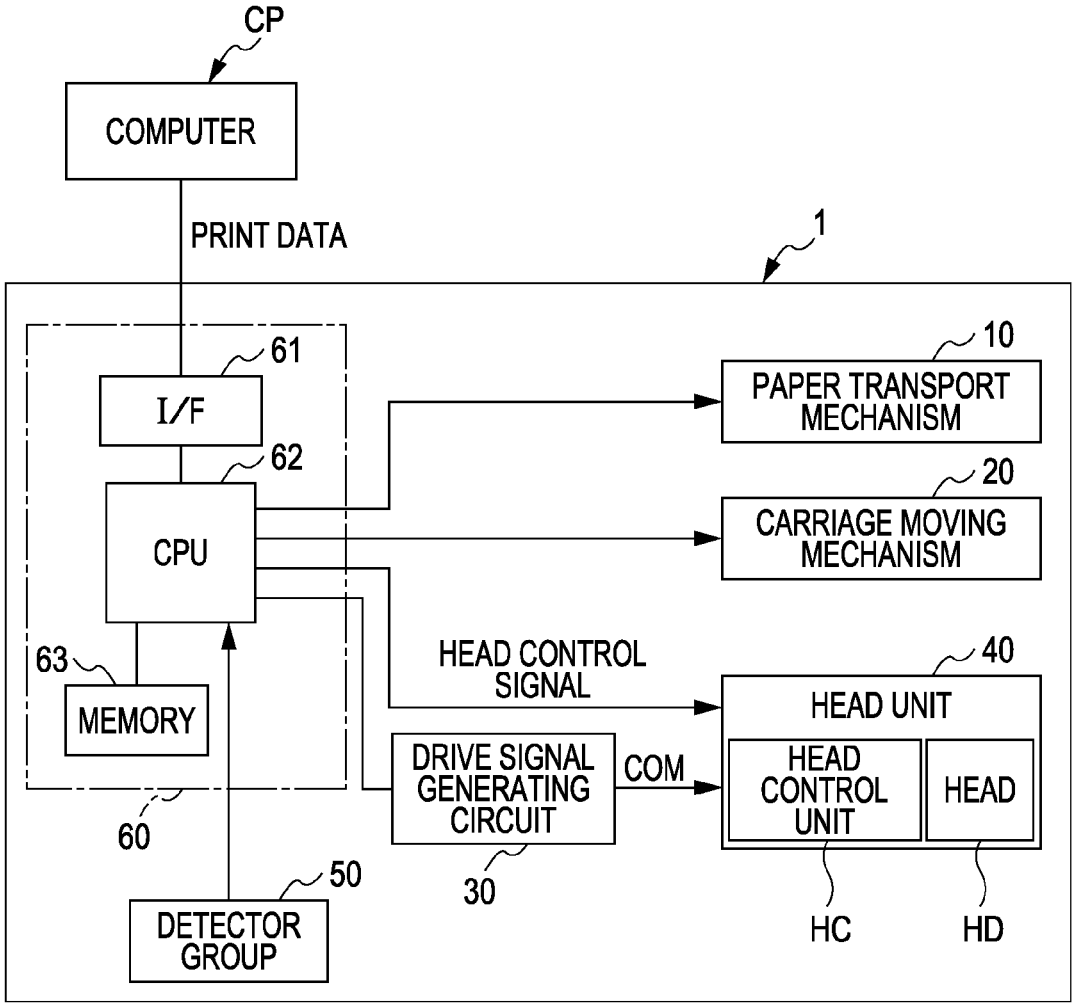
FIG. 1 is a block diagram illustrating a configuration of a print system.

By the description of the specification and the accompanying drawings of the present invention, at least the following particulars will be clear.

That is, it is clear that a liquid discharge apparatus is realized, which includes a nozzle from which liquid is discharged, a pressure chamber that gives a pressure change to the liquid in order to discharge the liquid from the nozzle, a liquid supply portion that communicates with the pressure chamber and supplies the liquid to the pressure chamber, a device that performs an operation for giving the pressure change to the liquid in the pressure chamber, and a discharge pulse generating unit that generates a discharge pulse for operating the device in order to discharge the liquid from the nozzle, wherein a viscosity of the liquid is equal to or higher than 8 millipascal seconds, the nozzle has a first portion of which a liquid discharge side has an opening area that is smaller than that of a pressure chamber side and a second portion that communicates with an end portion of the discharge side of the first portion, an opening area of the discharge side end portion of the second portion is equal to or smaller than 1/9 of the opening area on the pressure chamber side as an opening of the liquid supply portion, and the discharge pulse has a decompression portion that decompresses the liquid to lead a meniscus positioned in the second portion to the first portion and a compression portion that compresses the liquid to discharge the liquid before the meniscus which has been led to the first portion returns to the second portion.

According to this liquid discharge apparatus, the amount of liquid that is discharged from a nozzle and the amount of liquid that is supplied to a pressure chamber are optimized by the size of an opening of the nozzle and the size of an opening of a supply portion. Accordingly, insufficient supply of liquid to the pressure chamber is improved, and thus the discharge of the liquid is stabilized.

In addition, if the device is operated by the compression portion, the pressure on the second portion side in the first portion is locally heightened. Accordingly, the pressure that is given to the liquid can be efficiently used for the liquid discharge, and further, the high-viscosity liquid can be efficiently discharged.

In such a liquid discharge apparatus, it is preferable that the opening area of the discharge side end portion of the second portion is equal to or larger than 1/20 of the opening area on the pressure chamber side.

According to this liquid discharge apparatus, when ink is pressed in the pressure chamber, an ink flow can occur even on the nozzle side, and stabilized, and thus ink drops can be surely discharged.

In such a liquid discharge apparatus, it is preferable that the discharge pulse has a maintenance portion that maintains the state of the device in the generation end timing of the decompression portion over a period from the end of generation of the decompression portion to the start of application of the compression portion.

According to the liquid discharge apparatus, by determining the generation time of the maintenance portion, the compression start timing by the compression portion can be determined. Due to this, the timing can be easily optimized.

In such a liquid discharge apparatus, it is preferable that impedance of the nozzle is lower than that of the liquid supply portion.

According to such a liquid discharge apparatus, pressure oscillation that occurs in the liquid in the pressure chamber can be efficiently transferred to the nozzle side, and thus the high-viscosity liquid can be efficiently discharged.

In such a liquid discharge apparatus, it is preferable that the first portion of the nozzle partitions a space in the shape of a circular truncated cone having a taper angle of equal to or larger than 40 degrees.

According to such a liquid discharge apparatus, the tail portion of a liquid drop being excessively lengthened can be suppressed. At this time, the term "40 degrees" does not indicate a strict angle, and somewhat of a difference is permitted.

In such a liquid discharge apparatus, it is preferable that the first portion of the nozzle is determined in a taper angle range according to the viscosity of the liquid.

According to such a liquid discharge apparatus, the tail portion of a liquid drop being excessively lengthened can be further suppressed.

In such a liquid discharge apparatus, it is preferable that the second portion of the nozzle has a cross-sectional area in the shape which is almost unchanged on a surface that is orthogonal to a nozzle direction.

According to such a liquid discharge apparatus, a flying direction of the discharged liquid drop can be stabilized.

In such a liquid discharge apparatus, it is preferable that the second portion of the nozzle has a length in a discharge direction, which is shorter than an inside diameter of the opening.

According to such a liquid discharge apparatus, pressure oscillation that occurs in the liquid in the pressure chamber can be efficiently transferred to the nozzle side.

In such a liquid discharge apparatus, it is preferable that the second portion of the nozzle partitions another space in the shape of a circular truncated cone having a taper angle that is smaller than that of the first portion.

According to such a liquid discharge apparatus, a flying speed of the liquid drop can be heightened.

In such a liquid discharge apparatus, it is preferable that the device is a piezoelectric device which gives a pressure change to the liquid by changing a capacity of the pressure chamber through deformation in accordance with an electric potential of the applied discharge pulse.

According to such a liquid discharge apparatus, the pressure that is given to the liquid can be minutely controlled.

In such a liquid discharge apparatus, it is preferable that the degree of capacity change of the pressure chamber per unit time by the compression portion is set to be higher than the degree of capacity change of the pressure chamber per unit time by the decompression portion, and the discharge pulse does not have a portion for suppressing movement of the meniscus after the discharge of the liquid, following the compression portion.

According to such a liquid discharge apparatus, a strong pressure by the liquid of the first portion can be given. Also, it is suitable to the high-frequency discharge of liquid drops.

Also, it is clear that a liquid discharge method can be realized, which discharges liquid having viscosity that is equal to or higher than 8 millipascal seconds from a nozzle using a liquid discharge apparatus including the nozzle from which liquid is discharged, a pressure chamber that gives a pressure change to the liquid in order to discharge the liquid from the nozzle, a liquid supply portion that communicates with the pressure chamber and supplies the liquid to the pressure chamber, and a device that performs an operation for giving the pressure change to the liquid in the pressure chamber, wherein the nozzle has a first portion of which a liquid discharge side has an opening area that is smaller than that of a pressure chamber side and a second portion that communicates with an end portion of the discharge side of the first portion, wherein an opening area of the discharge side end portion of the second portion is equal to or smaller than ⅙ of the opening area on the pressure chamber side as an opening of the liquid supply portion, the liquid discharge method includes the steps of decompressing the liquid to lead a meniscus positioned in the second portion to the first portion; and compressing the liquid to discharge the liquid before the meniscus which has been led to the first portion returns to the second portion.

First Embodiment

Regarding a Print System

A print system as exemplified in FIG. 1 has a printer 1 and a computer CP. The printer 1 corresponds to a liquid discharge apparatus, and discharges ink, which is a kind of liquid, toward a medium, such as paper, cloth, film, or the like. The medium is an object to which the liquid is to be discharged. The computer CP is communicably connected to the printer 1. In order to make the printer 1 print an image, the computer CP transmits print data according to the image to the printer 1.

Summary of a Printer 1

The printer 1 has a paper transport mechanism 10, a carriage moving mechanism 20, a drive signal generating circuit 30, a head unit 40, a detector group 50, and a printer-side controller 60.

The paper transport mechanism 10 transports paper in a transport direction. The carriage moving mechanism 20 moves a carriage that is attached to the head unit 40 in a specified moving direction (e.g. in a paper width direction). The drive signal generating unit 30 generates a drive signal COM. This drive signal COM is applied to a head HD (a piezoelectric device 433 (see FIG. 2)) during printing on paper, and, as illustrated as an example in FIG. 5, includes a discharge pulse PS. Here, the discharge pulse PS is a changed pattern of electric potential that makes the piezoelectric device 433 perform a specified operation in order to discharge ink in the form of droplets from the head HD (a nozzle 427). Since the drive signal COM includes the discharge pulse PS, the drive signal generating circuit 30 corresponds to the discharge pulse generating unit. The configuration of the drive signal generating circuit 30 and the discharge pulse PS will be described later. The head unit 40 has a head HD and a head control unit HC. The head HD discharges aqueous ink toward paper, and corresponds to a liquid discharge head. The head control unit HC controls the head HD on the basis of a head control signal from a printer-side controller 60. The head HD will be described later. The detector group 50 is composed of a plurality of detectors which monitor the situation of the printer 1. The results of detection by these detectors are output to the printer-side controller 60. The printer-side controller 60 wholly performs the control in the printer 1. This printer-side controller 60 will be described later.

Primary Portions of a Printer 1

Regarding a Head HD

Figure 2:
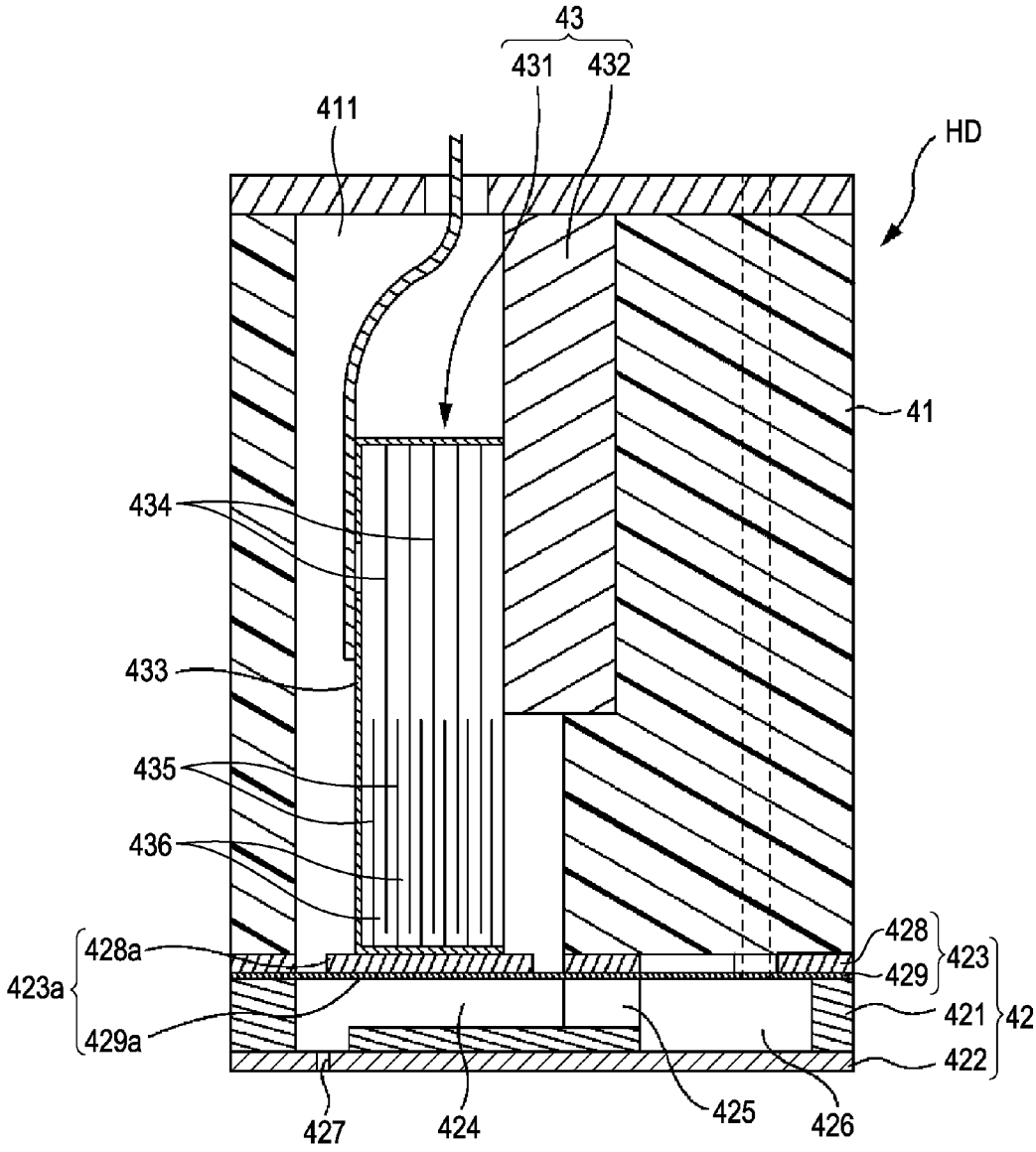
FIG. 2 is a cross-sectional view of a head.

As illustrated in FIG. 2, the head HD has a case 41, a flow path unit 42, and a piezoelectric device unit 43. In the case 41, an accommodation space portion 411 for accommodating and fixing the piezoelectric device unit 43 therein is installed. This case 41, for example, is made of a resin material. Also, the tip end surface of the case 41 joins the flow path unit 42.

The flow path unit 42 has a flow path forming substrate 421, a nozzle plate 422, and an oscillating plate 423. Also, a surface of one side of the flow path forming substrate 421 joins the nozzle plate 422, and a surface of the other side thereof joins the oscillating plate 423. On the flow path forming substrate 421, a pressure chamber 424, an ink supply path 425, a common ink chamber 426, and the like, are installed. The flow path forming substrate 421 may be made of a silicon substrate. The pressure chamber 424 is formed as a thin and long space in a direction that is orthogonal to a direction in which nozzles 427 stand in a row. The ink supply path 425 is a portion of a narrow flow path which communicates between the pressure chamber 424 and the common ink chamber 426. The ink supply path 425 corresponds to a liquid supply portion for supplying the liquid to the pressure chamber 424. The common ink chamber 426 is a portion that first stores the ink supplied from an ink cartridge (not illustrated), and corresponds to a common liquid storage chamber.

On the nozzle plate 422, a plurality of nozzles 427 is installed at predetermined intervals in a predetermined direction in which the nozzles stand in a row. The nozzle plate 422 is made of, for example, a stainless steel plate or a silicon substrate. The details of the nozzles 427 installed on the nozzle plate 422 will be described later.

The oscillating plate 423 adopts a double structure in which an elastomer layer 429 of a resin material is laminated on a support plate 428 of a stainless steel material. In a portion which corresponds to each pressure chamber 424 on the oscillating plate 423, a portion of the stainless plate is etched and processed in the form of a ring, and inside the ring, an island portion **428*a* is formed. The island portion 428*a* and the elastomer layer 429*a* around the island portion 428*a* constitute a diaphragm portion 423*a*. This diaphragm portion 423*a* is deformed by the piezoelectric device 433 included in the piezoelectric device unit 43 and varies the capacity of the pressure chamber 424**.

The piezoelectric device unit 43 has a piezoelectric device group 431 and a fixing plate 432. The piezoelectric device group 431 is in a pectinate shape. In this case, each tooth corresponds to a piezoelectric device 433. The tip end surface of each piezoelectric device 433 is adhered to the corresponding island portion **428*a*. The fixing plate 432 supports the piezoelectric device group 431, and serves as a mount portion for the case 41. The fixing plate 432 is formed of, for example, a stainless steel plate, and is adhered to the inner wall of the accommodation space portion 411**.

The piezoelectric device 433 is a kind of an electro-mechanic conversion device, and corresponds to a device that performs an operation (deformation operation) for giving a pressure change to the liquid inside the pressure chamber 424. The piezoelectric device 433 as illustrated in FIG. 2 expands and contracts in a device length direction that is orthogonal to the lamination direction by giving an electric potential difference between neighboring electrodes. That is, the aforementioned electrode has a common electrode 434 of a specified electric potential and a drive electrode 435 having the electric potential according to the drive signal COM (the discharge pulse PS). Also, a piezoelectric body 436 that is sandwiched between both electrodes 434 and 435 is deformed to the extent according to an electric potential difference between the common electrode 434 and the drive electrode 435. The piezoelectric device 433 expands and contracts in a device length direction according to the deformation of the piezoelectric body 436. The common electrode 434 has a bias electric potential that is determined to be the ground electric potential or to be higher than the ground electric potential for only a specified electric potential. Also, the piezoelectric device 433 contracts as the electric potential of the drive electrode 435 becomes higher than the electric potential of the common electrode 434. By contrast, the piezoelectric device 433 expands as the electric potential of the drive electrode 435 approaches the electric potential of the common electrode 434, or as the electric potential of the drive electrode 435 becomes lower than the electric potential of the common electrode 434.

As described above, the piezoelectric device unit 43 is attached to the case 41 via the fixing plat 432. Due to this, if the piezoelectric device 433 contracts, the diaphragm portion 423*a* is pulled in a direction which becomes more distant from the pressure chamber 424, and thus the pressure chamber 424 expands. By contrast, if the piezoelectric device 433 expands, the diaphragm portion 423*a* is pushed to the side of the pressure chamber 424, and thus the pressure chamber 424 contracts. In the ink inside the pressure chamber 424, a pressure change occurs due to the expansion or contraction of the pressure chamber 424. That is, as the pressure chamber 424 contracts, the ink inside the pressure chamber 424 is compressed, and as the pressure chamber 424 expands, the ink inside the pressure chamber 424 is decompressed. Since the expansion/contraction state of the piezoelectric device 433 is determined according to the electric potential of the drive electrode 435, the capacity of the pressure chamber 424 is also determined according to the electric potential of the drive electrode 435. Accordingly, the degree of compression or decompression of the ink inside the pressure chamber 424 can be determined as an electric potential change amount per unit time in the drive electrode 435.

Regarding an Ink Flow Path

Figure 3:
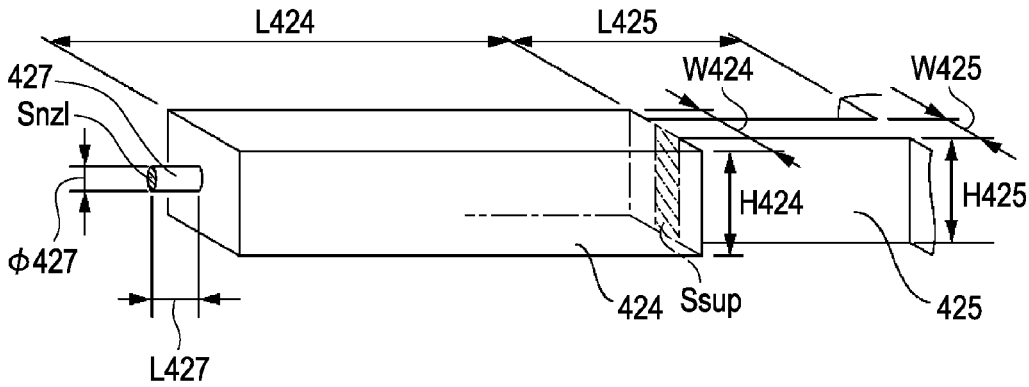
FIG. 3 is a view schematically illustrating the structure of a head.

On the head HD, a series of ink flow paths (corresponding to aqueous flow paths filled with liquid), which are arranged from the common ink chamber 426 to the nozzle 427, is installed in accordance with the number of nozzles 427. In the ink flow paths, the nozzle 427 and the ink supply path 425 each communicate with the pressure chamber 424. Accordingly, in the case of interpreting the characteristics such as ink flow or the like, the way of thinking of the Helmholtz resonator is adopted. FIG. 3 is a view schematically illustrating the structure of a head HD based on this way of thinking.

In a general head HD, the length L424 of the pressure chamber 424 is determined in the range of 200 μm to 2000 μm. The width W424 of the pressure chamber 424 is determined in the range of 20 μm to 300 μm, and the height H424 of the pressure chamber 424 is set in the range of 30 μm to 500 μm. Also, the length L425 of the ink supply path 425 is determined in the range of 50 μm to 2000 μm. The width W425 of the ink supply path 425 is determined in the range of 20 μm to 300 μm, and the height H425 of the ink supply path 425 is determined in the range of 30 μm to 500 μm. Also, the diameter ϕ427 of the nozzle 427 is determined in the range of 10 μm to 35 μm, and the length L427 of the nozzle 427 is determined in the range of 40 μm to 100 μm.

In the head HD according to the embodiment of the present invention, an opening area Snzl of the discharge side end portion of the nozzle 427 is determined based on the opening area Ssup of the ink supply path 425, and as illustrated in FIG. 3, the opening area Snzl of the discharge side of the nozzle 427 is determined to be equal to or smaller than 1/9 of the opening area Ssup of the pressure chamber side 424 of the ink supply path 425.

In this case, the width W425 and the height H425 of the ink supply path 425 are determined to be equal to or smaller than the width W424 and the height H424 of the pressure chamber 424, respectively. Also, in the case where one of the width W425 and the height H425 of the ink supply path 425 is uniformly arranged on one of the width W424 and the height H424 of the pressure chamber 424, the other of the width W425 and the height H425 of the ink supply path 425 is determined with a size that is smaller than that of the other of the width W424 and the height H424 of the pressure chamber 424.

In the ink flow path as described above, by giving the pressure change to the ink inside the pressure chamber 424, the ink is discharged from the nozzle 427. In this case, the pressure chamber 424, the ink supply path 425, and the nozzle 427 function as the Helmholtz resonator. Accordingly, the level of pressure that is applied to the ink inside the pressure chamber 424 is changed in an inherent period that is called a Helmholtz period. That is, pressure oscillation occurs in the ink. The Helmholtz period is also called an inherent oscillation period of the ink (liquid) in the pressure chamber 424. By the pressure oscillation in the Helmholtz period, the meniscus (free surface of ink exposed by the nozzle 427) is periodically moved within the nozzle 427. Also, by using the pressure change of the Helmholtz period, the ink can be efficiently discharged from the nozzle 427.

In a general head HD, the Helmholtz period is determined in the range of 5 μs to 10 μs. For example, in the ink flow path of FIG. 3, if it is assumed that the width W424, the height H424, and the length L424 of the pressure chamber 424 are set to 100 μm, 70 μm, and 1000 μm, respectively, the width W425, the height H425, and the length L425 of the ink supply path 425 are set to 55 μm, 80 μm, and 600 μm, respectively, and the diameter ϕ427 and the length L427 of the nozzle 427 are set to 24 μm and 100 μm, respectively, the Helmholtz period becomes about 8 μs. The Helmholtz period is changed even by the thickness of partitions that partition the neighboring pressure chambers 424, the thickness or compliance of the elastomer layer 429, and materials of the flow path forming substrate 421 or the nozzle plate 422.

Regarding a Printer-Side Controller 60

The printer-side controller 60 wholly performs control in the printer 1. For example, the printer-side controller 60 controls controller members to be controlled on the basis of print data received from the computer CP or the results of detection received from the respective detectors to print an image on a paper. As illustrated in FIG. 1, the printer-side controller 60 has an interface unit 61, a CPU 62, and a memory 63. The interface unit 61 performs data exchange with the computer CP. The CPU 62 wholly performs control of the printer 1. The memory 63 secures a region for storing computer programs, a task region, and the like. The CPU 62 controls the respective controller members to be controlled in accordance with the computer programs stored in the memory 63. For example, the CPU 62 controls the paper transport mechanism 10 or the carriage moving mechanism 20. Also, the CPU 62 transmits a head control signal for controlling the operation of the head HD to the head control unit HC, or transmits a control signal for generating a drive signal COM to the drive signal generating circuit 30.

Here, the control signal for generating the drive signal COM is called DAC data, for example, digital data composed of plural bits. This DAC data determines the change pattern of the electric potential of the generated drive signal COM. Accordingly, the DAC data may be data that indicates the electric potential of the drive signal COM or the discharge pulse PS. The DAC data is stored in a specified region of the memory 63, and is read to be output to the drive signal generating circuit 30 when the drive signal COM is generated.

Regarding a Drive Signal Generating Circuit 30

Figure 4:
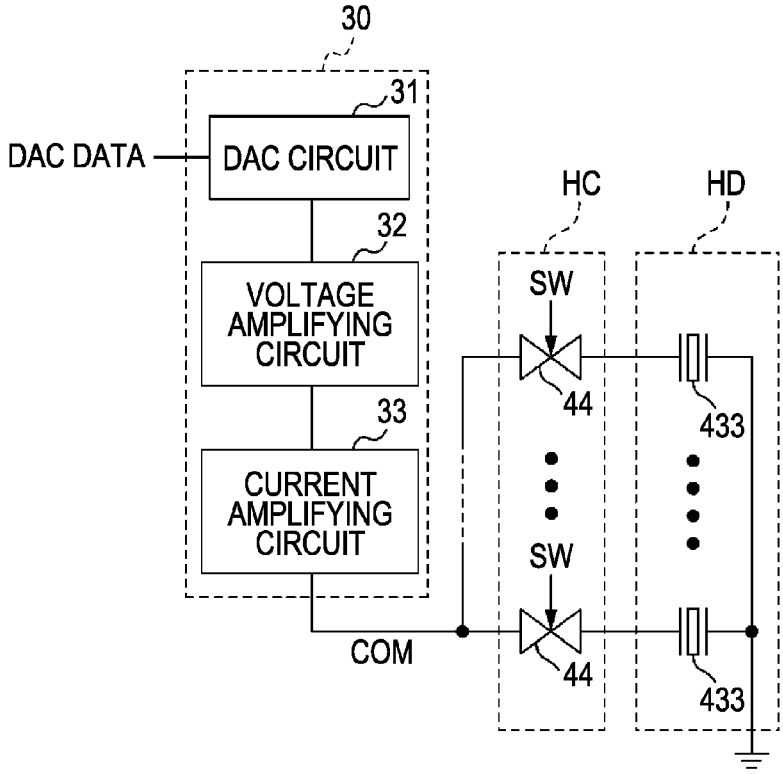

The drive signal generating circuit 30 functions as the discharge pulse generating unit, and generates the drive signal COM having the discharge pulse PS on the basis of the DAC data. As illustrated in FIG. 4, the drive signal generating circuit 30 has a DAC circuit 31, a voltage amplifying circuit 32, and a current amplifying circuit 33. The DAC circuit 31 converts digital DAC data into an analog signal. The voltage amplifying circuit 32 amplifies the voltage of the analog signal converted by the DAC circuit 31 to a level that can drive the piezoelectric device 433. In the printer 1, the voltage of the analog signal output from the DAC circuit 31 may be 3.3V at maximum, and the voltage of the analog signal (for convenience, referred to as a "waveform signal") amplified by the voltage amplifying circuit 32 may be 42V at maximum. The current amplifying circuit 33 amplifies the current of the waveform signal output from the voltage amplifying circuit 32, and outputs the amplified signal as the drive signal COM. The current amplifying circuit 33 is composed of, for example, a pair of push-pull connected transistors.

Regarding a Head Control Unit HC

The head control unit HC selects a necessary part of the drive signal COM generated by the drive signal generating circuit 30 on the basis of the head control signal, and applies the selected drive signal COM to the piezoelectric device 433. Accordingly, as illustrated in FIG. 4, the head control unit HC has a plurality of switches 44 installed for each of the piezoelectric devices 433 in the middle of supply lines of the drive signal COM. Also, the head control unit HC generates a switch control signal from the head control signal. By controlling the respective switches 44 with the switch control signal, the necessary part of the drive signal COM (e.g. the discharge pulse PS) is applied to the piezoelectric device 433.

Regarding a Drive Signal COM

Figure 5:
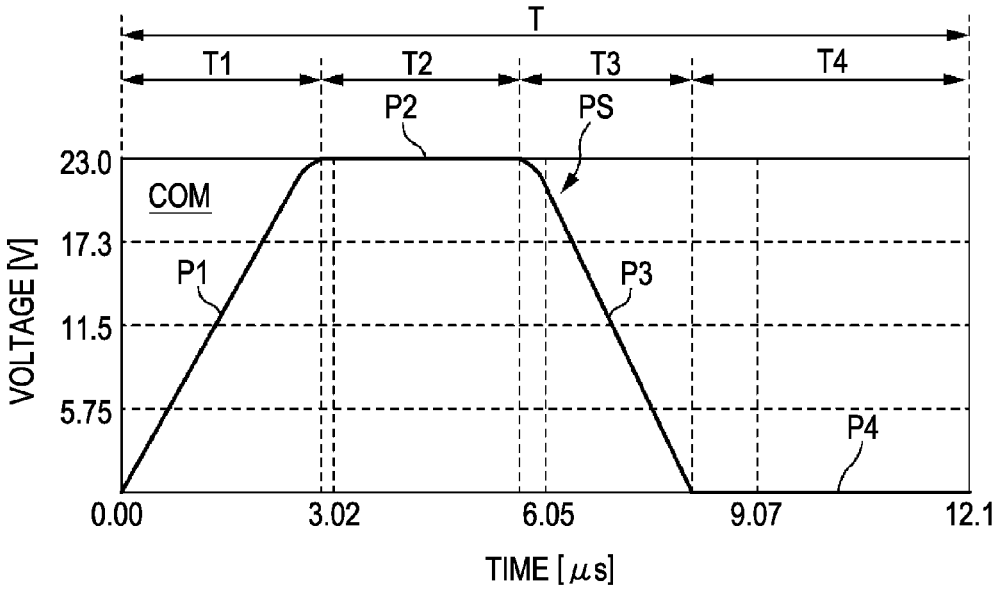
FIG. 5 is a view illustrating an example of a drive signal.

Next, the drive signal COM that is generated by the drive signal generating circuit 30 will be described. FIG. 5 is a view illustrating a drive signal COM. In FIG. 5, a vertical axis represents voltage of a drive signal COM, and a horizontal axis represents time. In this embodiment of the present invention, the drive signal generating circuit 30 generates the drive signal COM having a voltage based on the ground electric potential, and the common electrode 434 of the piezoelectric device 433 is determined as the ground electric potential. Due to this, the voltage of the drive signal COM indicates the electric potential of the drive electrode 435 that is determined by the drive signal COM.

As illustrated in the drawing, the drive signal COM includes the discharge pulse PS. This drive signal COM is applied to the drive electrode 435. Accordingly, an electric potential difference according to the waveform of the discharge pulse PS (corresponding to the change pattern of the electric potential) occurs between the drive electrode and the common electrode 434 having the fixed electric potential. As a result, the piezoelectric device 433 contracts according to the waveform, and changes the capacity of the pressure chamber 424.

The discharge pulse PS is in a trapezoidal waveform. If the discharge pulse PS having the trapezoidal waveform is applied to the piezoelectric device 433 (specifically, the drive electrode 435), the capacity of the pressure chamber expands from the minimum capacity that corresponds to the lowest electric potential to the maximum capacity that corresponds to the highest electric potential, and then contracts again to the minimum capacity. When the capacity of the pressure chamber 424 contracts from the maximum capacity to the minimum capacity, the ink inside the pressure chamber 424 is compressed, and thus the ink in the shape of droplets (ink drops) is discharged from the nozzle 427.

In the discharge pulse PS exemplified in FIG. 5, a portion which is changed from the lowest voltage to the highest voltage corresponds to a decompression portion P1 which decompresses the ink inside the pressure chamber 424, and a portion which is changed from the highest voltage to the lowest voltage corresponds to a compression portion P3 which compresses the ink to discharge the ink. Also, a predetermined portion at the highest voltage corresponds to a maintenance portion P2 that maintains the state of the piezoelectric device 433 in the application end timing of the decompression portion P1. Accordingly, the discharge pulse PS does not have a portion for suppressing an excessive reciprocating movement of a meniscus (which is called an oscillation control portion) after the ink drops are discharged. This is because in a high-viscosity ink (which is a kind of high-viscosity liquid) that is used in the printer 1, the movement of the meniscus after the ink drops are discharged by the ink viscosity and so on is performed earlier than that in the aqueous ink that is generally spread. Since the discharge pulse PS does not have the oscillation control portion, a period for generating the discharge pulse PS can be shortened to a necessary period, and thus the ink drops can be discharged at high frequency.

In the discharge pulse PS, a generation period T1 of the decompression portion P1 is 2.8 μs, the lowest voltage is 0V, and the highest voltage is 23V. Also, a generation period T2 of the maintenance portion P2 is 2.8 μs, and a generation period T3 of the compression portion P3 is 2.4 μs. The drive signal generating circuit 30 generates a predetermined portion P4 at the lowest voltage to follow the discharge pulse PS. This portion P4 is generated in a period T4 that is to the start of the generation of the next discharge pulse PS, and corresponds to the connection portion. The drive signal generating circuit 30 repeatedly generates the drive signal COM that includes the discharge pulse PS for every repetition period T.

The generation periods of the respective portions P1 to P3 in the discharge pulse PS, the lowest voltage, and the highest voltage are properly adjusted by type of ink (liquid) to be discharged, the necessary flying speed of the ink drop, the length of a tail portion of the ink drop, and the like. Also, with respect to the decompression portion P1 and the compression portion P3, it is preferable that the degree of capacity change of the pressure chamber 424 per unit time caused by the compression portion P3 is set to be higher than the degree of capacity change of the pressure chamber 424 per unit time caused by the decompression portion P1. This is because the decompression portion P1 operates to fill the ink in the pressure chamber 424, and the compression portion P3 operates to discharge the ink drops from the nozzle 427. By doing this, the ink can be compressed in a state where the ink is sufficiently filled in the pressure chamber 424. As a result, in discharging the ink drops, a strong pressure can be given by the ink neighboring the nozzle 427.

Regarding a Reference Example

In such a kind of printer, it has been proposed that the nozzle has a tapered portion (a portion that partitions a space in the shape of a circular truncated cone) and a straight portion (a portion that partitions a space in the shape of a cylinder). However, even though a nozzle in the above-described shape is used, the discharge of the ink drops may become unstable. One of the main causes may be the fact that the pressure change that is given to the liquid in the pressure chamber has not been efficiently used to discharge the liquid. For example, in the case of discharging the ink drops by moving the meniscus within the range of the straight portion, the viscous force from the inner wall of the straight portion surpasses the inertia force of the liquid that exists in the center of the straight portion, and thus it is considered that this may disturb the discharge of the ink drops, or this may make the discharge rate insufficient.

Figure 6B:
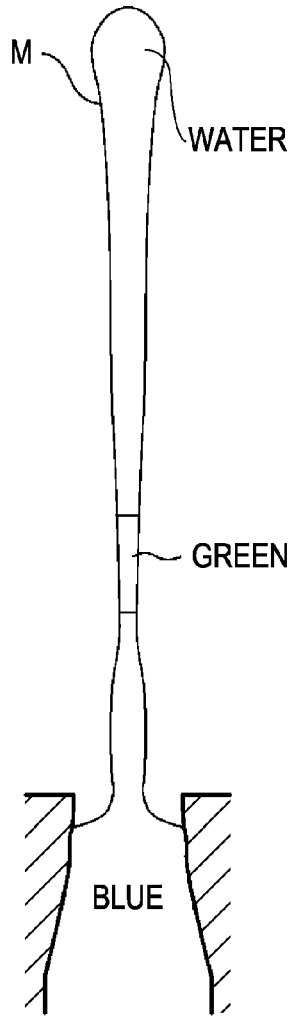
FIG. 6B is a view schematically illustrating the shape of a meniscus M and pressure distribution after an application of a compression portion.
Figure 6A:
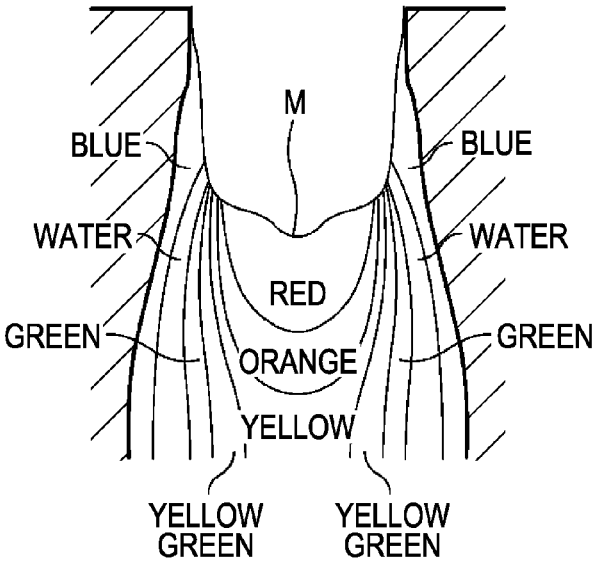
FIG. 6A is a view schematically illustrating the shape of a meniscus M and pressure distribution during an application of a compression portion.
Figure 6C:
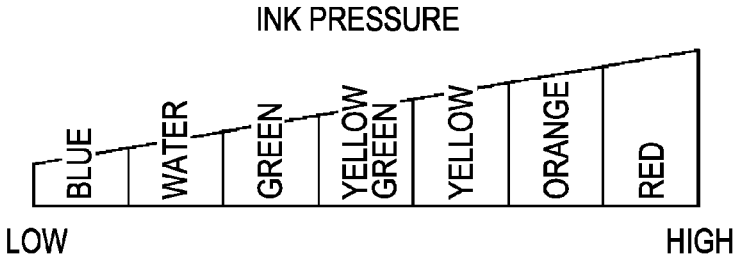
FIG. 6C is a view illustrating relations between ink pressure and color.

FIGS. 6A to 6C are views illustrating a case in which the discharge becomes unstable due to the compression timing. FIG. 6A is a view schematically illustrating the shape of the meniscus M and pressure distribution during an application of the compression portion. FIG. 6B is a view schematically illustrating the shape of the meniscus M and pressure distribution after an application of the compression portion. FIG. 6C is a view illustrating relations between the ink pressure and color.

In FIG. 6A, a state in which the meniscus M is led not to exceed the straight portion by applying the decompression portion and the maintenance portion of the discharge pulse to the piezoelectric device, and then the compression portion is applied is illustrated. In the drawing, a color such as blue, red, or the like, indicates the pressure of the liquid. That is, as illustrated in FIG. 6C, the side on which the pressure is low is indicated by a color of blue series, and the side on which the pressure is high is indicated by a color of red series. Specifically, seven stages are indicated by using blue, water, green, yellow green, yellow, orange, and red in order, starting from the low-pressure side. Also, the pressure distribution is indicated by drawing isobars on respective pressure boundaries.

In this case, each color does not indicate an absolute pressure level, but indicates a relative pressure difference. That is, a region having the lowest pressure at that time point is indicated by a blue color, and colors are discriminated on the basis of the blue color region. The expressions of the pressure on the basis of such colors are made in the same manner in other drawings (e.g. FIGS. 9B, 10B, . . . , 17B).

In FIG. 6A, a red region having the highest pressure exists on a bottom portion of the meniscus M. The red region is distributed in the form of a semi-ellipse from the bottom portion of the meniscus M to the pressure chamber side (in the drawing, a lower side). Around the red color region, an orange region having a second highest pressure is distributed in the shape of a bow. Also, around the orange region, a yellow region having a third highest pressure is distributed in an abbreviated Y-shape. Also, on the side of the yellow region, a yellow green region or a green region is distributed, and on the side of the green region, a water region or a blue region is distributed. In the drawing, it can be seen that the red, orange, and yellow regions having high pressure are distributed to extend toward the pressure chamber side. As the portions having high pressure are distributed to extend, as illustrated in FIG. 6B, the pressure at the tip end portion of the ink cylinder is insufficient, and thus the ink drops may not be discharged or the discharge rate become insufficient.

Figure 7:
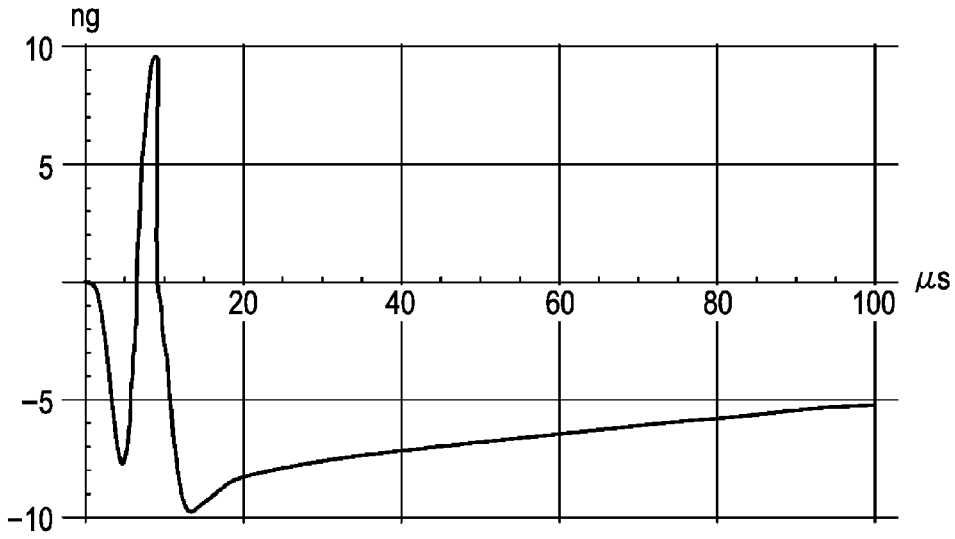
FIG. 7 illustrates simulation data explaining a case in which the discharge becomes unstable due to an impedance ratio of a nozzle to an ink supply path.

FIG. 7 is simulation data explaining a case where the discharge becomes unstable due to the impedance ratio of the nozzle to the ink supply path. In FIG. 7, the vertical axis represents the state of the meniscus M as an ink amount, and the horizontal axis represents time. On the vertical axis, "0ng" indicates the position of the meniscus M in a normal state. Also, as the value is increased on the positive side, the meniscus M is in a state where it is pushed in the discharge direction, while as the value is increased on the negative side, the meniscus M is in a state where it is led into the pressure chamber side.

In the simulation data of FIG. 7, the impedance of the nozzle is determined to be larger than the impedance of the ink supply path. Specifically, the diameter of the straight portion of the nozzle, the length of the straight portion, and the length of the nozzle are set to 28 μm, 20 μm, and 60 μm, respectively, the taper angle is set to 25 degrees, and the width, the height, and the length of the ink supply path are set to 100 μm, 100 μm, and 500 μm, respectively. Accordingly, in the ink having the viscosity of 30 mPa·s, the impedance of the nozzle becomes $1.59\times10^{14}\Omega$, and the impedance of the ink supply path becomes $1.27\times10^{14}\Omega$. In this case, the respective impedances are obtained by calculating and making respective elements of compliance, resistance, and inertance correspond to values of an electric circuit, respectively.

If the impedance of the nozzle is larger than the impedance of the ink supply path, there occurs a problem that the pressure change which is given to the ink in the pressure chamber is not efficiently used to discharge the ink. That is, most of the pressure change that is given to the ink in the pressure chamber propagates to the common ink chamber side through the ink supply path. Accordingly, the degree of movement of the meniscus M is lowered against the pressure change of the ink, and thus the ink drops may not be discharged or the discharge rate cannot keep pace. Also, after the ink drops are discharged, time is necessary until the meniscus M returns to a normal state. It is considered that this is because the viscous force of the nozzle surface becomes excessively increased if the impedance of the nozzle is high. Also, even in a state where the meniscus M is led into the pressure chamber side, a difference between the ink pressure in the pressure chamber and the ink pressure in the common ink chamber becomes smaller, and thus the ink flow from the common ink chamber side to the compression chamber side is weakened. In other words, the surface tension of the meniscus M becomes dominant over all the others.

Regarding Features of a Printer 1

In consideration of the situation as described above, the printer 1 has adopted the following configuration to improve the discharge characteristics of the ink drops. First, the nozzle 427 has been configured to have a tapered portion 427*a* in which the ink discharge side has an opening area that is determined to be smaller than that of the pressure chamber side 424, and a straight portion 427*b* that communicates with the tip end portion on the discharge side of the tapered portion 427*a* (see FIG. 8A). Also, with respect to the discharge pulse PS, it is determined that the meniscus M positioned in the straight portion 427*b* is led to the tapered portion 427*a* by the decompression portion P1 that decompresses the ink inside the pressure chamber 424, and the application start timing of the compression portion P3 that compresses the ink for the purpose of discharging the ink is determined to be before the meniscus M led to the tapered portion 427*a* returns to the straight portion 427*b*. According to this configuration, when the ink inside the pressure chamber 424 is compressed by applying the compression portion P3 to the piezoelectric device 433, the ink pressure on the straight portion side 427*b* of the tapered portion 427*a* can be locally heightened. In other words, the portion having a high pressure in the ink can be concentrated in the neighborhood of the meniscus M. Accordingly, the pressure change that is given to the ink can be efficiently used to discharge the ink drops. As a result, even a high-viscosity ink can be efficiently discharged. In addition, since the straight portion 427*b* is installed, the flying direction of the ink drops can be concentrated within a permitted range. That is, the flying direction can be stabilized. In addition, since a maintenance portion P2 is generated between the decompression portion P1 and the compression portion P3, the compression timing of the ink by the compression portion P3 can be easily determined by setting the generation period of the maintenance portion P2.

Also, the printer 1 adopts the following configuration in the head HD. That is, with respect to the nozzle 427 and the ink supply path 425, the impedance 2427 of the nozzle 427 is set to be lower than the impedance 2425 of the ink supply path 425 (liquid supply portion). According to this configuration, in the case where the pressure change is given to the ink inside the pressure chamber 424 by deforming the diaphragm portion 423*a* to the piezoelectric device 433, the contribution ratio to the movement of the meniscus M among the pressure change can be heightened in comparison to the contribution ratio in the related art. Accordingly, the portion having a high pressure can be easily concentrated upon the straight portion side 427*b* in the tapered portion 427*a* of the nozzle 427. Accordingly, the high-pressure portion can be easily concentrated upon the straight portion side 427*b* of the tapered portion 427*a* of the nozzle 427. Accordingly, the pressure change given to the ink can be efficiently used to discharge the ink drops. As a result, the discharge of the high-viscosity ink can be efficiently performed.

Regarding the Shape of a Nozzle 427

Figure 8A:
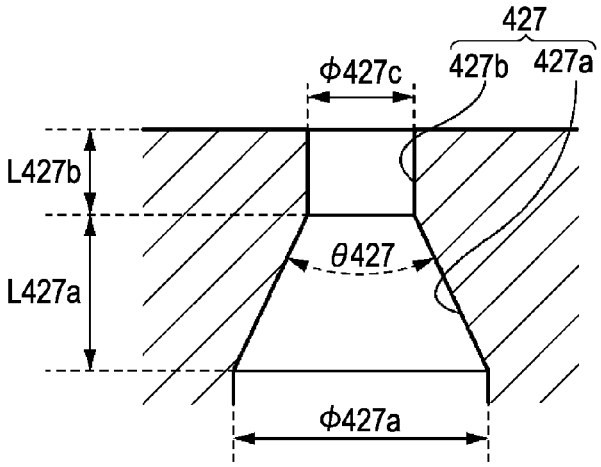
FIG. 8A is a cross-sectional view illustrating the shape of a nozzle.
Figure 8B:
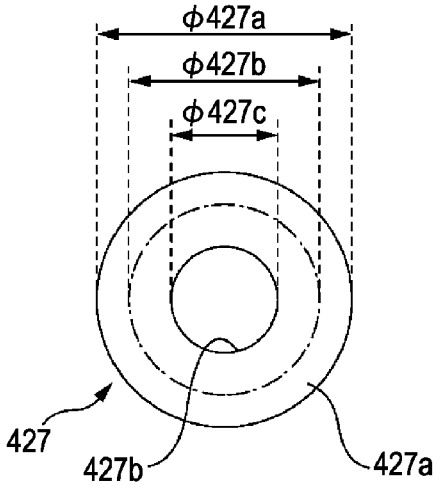
FIG. 8B is a view illustrating a nozzle as seen from the tapered portion side.

Hereinafter, the features of the nozzle will be described in detail. First is described the state of the shape of nozzle 427 and the shape of ink supply path 425. As illustrated in FIGS. 8A and 8B, the nozzle 427 is in the form of a funnel, and has a tapered portion 427*a* in the form of a taper and a straight portion 427*b* that communicates with the end portion of the discharge side of the tapered portion 427*a*. The tapered portion 427*a* is a portion that partitions a space in the form of a circular truncated cone, and corresponds to the first portion of the nozzle 427. The straight portion 427*b* corresponds to the second portion of the nozzle 427, has a shape that is almost unchanged on a surface of a cross-sectional area that is orthogonal to the nozzle direction, and is a portion that partitions a space in the form of a cylinder. In other words, the cross-sectional shape in a direction that is orthogonal to the discharge direction is a portion having a constant circle at any place in the discharge direction. The tapered portion 427*a* has the opening area that becomes larger toward the pressure chamber side 424 (lower side in FIG. 8A). In other words, the opening area on the discharge side of the ink drops is determined to be smaller than the opening area of the pressure chamber side 424. For example, the diameter ϕ427*b* in the center position of the tapered portion 427*a* is smaller than the diameter ϕ427*a* of the end portion on the pressure chamber side 424. Also, the diameter ϕ427*c* is smaller than the diameter ϕ427*b* in the center position of the end portion on the pressure chamber side 424 (the end portion on the straight portion side 427*b*).

In the embodiment of the present invention, the diameter ϕ427*c* of the end portion on the discharge side corresponds to the diameter of the straight portion 427*b*, and is determined as 30 μm. The length L427*b* of the straight portion 427*b*, i.e. the length in the discharge direction, is determined to be 20 μm, and the length L427*a* of the tapered portion 427*a* is set to 80 μm. Accordingly, the length L427 of the nozzle 427 becomes 100 μm. Also, the taper angle θ427 is set to 50 degrees. On the other hand, the width W425, the height H425, and the length L425 are set to 55 μm, 80 μm, and 600 μm, respectively. As a result, the impedance Z427 of the nozzle 427 becomes smaller than the impedance Z425 of the ink supply path 425. Specifically, in the ink having the viscosity of 30 mPa·s, the impedance Z427 of the nozzle 427 becomes $1.0\times10^{14}\Omega$, and the impedance Z425 of the ink supply path 425 becomes $1.27\times10^{14}\Omega$.

Regarding Relations Between an Ink Flow Path and a Nozzle

In such a kind of printer, as described above, there have been demands for efficient discharge of the ink and stabilization of the ink discharge. For example, in the case of discharging the ink drops at low frequency and in the case of discharging the ink drops at high frequency, there have been demands for making the amounts of ink drops, flying directions, flying speeds, or the like, equal to each other. However, in the case of discharging through a typical head the ink having a greatly higher viscosity than that of a general ink (having the viscosity of about one millipascal second), and specifically, the ink having the viscosity of 6 to 20 millipascal seconds (for convenience, also referred to as "high-viscosity ink"), the ink discharge becomes unstable.

One of various causes that make the ink discharge unstable may be an insufficient ink supply. The high-viscosity ink has the characteristics that it is difficult for the high-viscosity ink to pass through the ink supply path 425 in comparison to a general ink. Due to this, the supply of ink to the pressure chamber 424 cannot keep pace, and the ink discharge operation is performed in an insufficient ink state to cause the discharge of ink to become unstable.

Accordingly, in the head HD according to the embodiment of the present invention, the opening area of the nozzle 427 is prescribed based on the opening area of the ink supply path 425. That is, as illustrated in FIG. 3, the opening area Snzl on the discharge side of the nozzle 427 is set to be equal to or lower than 1/9 of the opening area Ssup on the pressure chamber side 424 of the ink supply path 425. Accordingly, the discharge rate of ink drops from the nozzle 427 is limited, and the ink supply rate to the pressure chamber 424 is secured. As a result, the insufficient ink supply to the pressure chamber 424 can be solved to stabilize the discharge of ink.

Further, as the opening area Snzl of the nozzle 427 becomes smaller than the opening area Ssup of the ink supply path 425, it becomes more difficult for the ink to flow through the inside of the nozzle 427. Due to this, the ink compressed in the pressure chamber 424 flows to the side of the ink supply path 425 in large quantities. If the opening area Snzl of the nozzle 427 is made to be excessively small, ink drops are not discharged from the nozzle 427 even though the ink is compressed in the pressure chamber 424.

In order to prevent the discharge inferiority of ink drops, the opening area Snzl of the nozzle 427 is set to be equal to or larger than 1/20 of the opening area Ssup of the ink supply path 425. By doing this, when the ink is compressed in the pressure chamber 424, the ink flow can occur even on the nozzle side 427, and thus the ink drops can be surely discharged.

With respect to the opening area of the nozzle 427, the inventor has performed experiments for evaluating the discharge stability of ink drops using the viscosity of the ink and the opening area as parameters. Table 1 shows the experimental results of evaluating the discharge stability of the ink drops. In the evaluation experiments, the opening area indicates a ratio of the opening area Snzl on the discharge side of the nozzle 427 to the opening area Ssup on the pressure chamber side 424.

TABLE 1

Results of evaluating the discharge stability of ink drops

| | | Opening Area | | | | | |
|---|---|---|---|---|---|---|---|
| | | 1/8 | 1/9 | 1/10 | 1/19 | 1/20 | 1/21 |
| Ink Viscosity | 6 mPas | Δ | ○ | ○ | ○ | ○ | X |
| | 8 mPas | Δ | ○ | ○ | ○ | ○ | Δ |
| | 10 mPas | Δ | ○ | ○ | ○ | ○ | Δ |
| | 15 mPas | Δ | ○ | ○ | ○ | ○ | Δ |
| | 20 mPas | X | ○ | ○ | ○ | ○ | ○ |
| | 25 mPas | X | Δ | Δ | Δ | Δ | Δ |
| | 30 mPas | X | X | X | X | Δ | Δ |

In Table 1, "○" indicates that the discharge is stable without occurrence of an insufficient flying speed or discharge bending of ink drops, "Δ" indicates that the discharge stability is insufficient due to occasional occurrence of an insufficient flying speed or discharge bending of ink drops, and "x" indicates that the insufficient flying speed or the discharge bending of ink drops frequently occurs and the discharge is very unstable.

Regarding Ink Discharge Control

Next, ink discharge control will be described. FIGS. 9 to 17 show the ink states around the nozzle 427 when the ink drop is discharged with the lapse of time from the application start of the discharge pulse PS. That is, FIGS. 9A, 10A, . . . , 17A illustrate elapsed time from the application start of the discharge pulse PS and voltage at the time. Also, FIGS. 9B, 10B, . . . , 17B schematically illustrate states of meniscus M and pressure distribution at the time of FIGS. 9A, 10A, . . . , 17A. It is assumed that the simulation has been performed with the ink having the viscosity of 30 mPa·s.

Figure 9A:
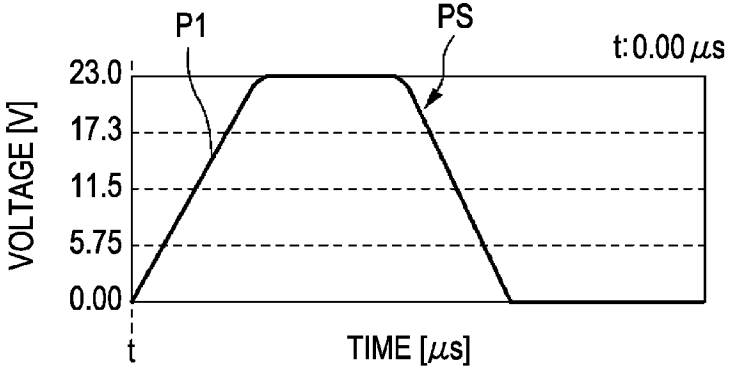
FIG. 9A is a view illustrating a voltage in the discharge pulse application start timing.
Figure 9B:
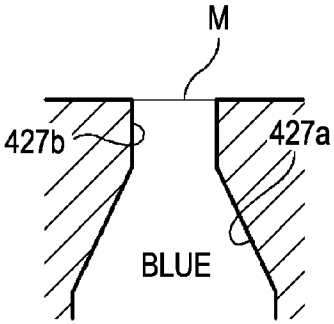
FIG. 9B is a view schematically illustrating the meniscus state and the pressure distribution in the timing of FIG. 9A.
Figure 10A:
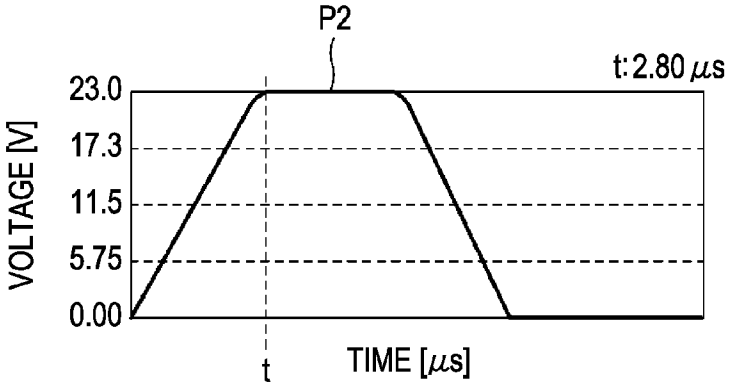
FIG. 10A is a view illustrating a voltage after the lapse of 2.80 μs from the discharge pulse application start timing.
Figure 10B:
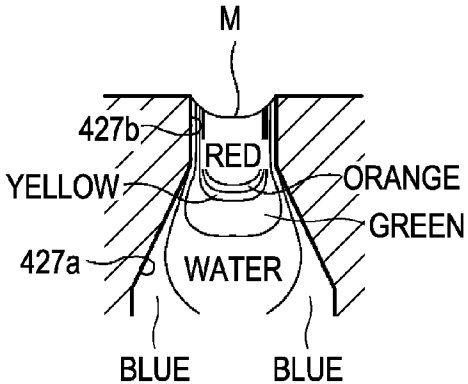
FIG. 10B is a view schematically illustrating the meniscus state and the pressure distribution in the timing of FIG. 10A.

As illustrated in FIGS. 9A and 9B, before the start of application of the discharge pulse PS (e.g. 0.00 μs) the meniscus M is in a normal state, and the ink pressure is stably in the lowest state (blue). As illustrated in FIGS. 10A and 10B, in the application end timing (e.g. 2.80 μs) of the decompression portion P1, the meniscus M is somewhat curved toward the pressure chamber side 424, and the red region is distributed from a bottom portion of the meniscus M to the pressure chamber side 424. The red region is distributed briefly in the form of a rectangle, and occupies a large part of the straight portion 427*b*. As described above, the color discrimination of the pressure indicates a difference between relative pressures. Accordingly, the red region indicates that the pressure is relatively heightened due to the lowering of pressure of the neighboring ink. Around the red region, an orange region is distributed to cover the red region, and a yellow region is distributed to cover the orange region. These regions are distributed like thin layers. On the outside of the yellow region, a green region is distributed. A portion (a bottom portion) on the pressure chamber side 424 in the green region is thickened in comparison to a portion on the pressure chamber side 424 in the orange region or the yellow region. That is, the portion is widely distributed to the pressure chamber side 424. On the outside of the green region, a water region is distributed. The distribution range of the water region is wider than the distribution range of the green region. In particular, the distribution range of the water region is widened in the portion on the pressure chamber side 424. Also, on the outside of the water region, a blue region is distributed. In this state, since the orange region and the yellow region are thin (a gap between isobars is narrow), it can be understood that a high-pressure region is concentrated upon the red region and in its neighborhood. From this, it can be recognized that a strong power for moving to the pressure chamber side 424 is acting on the meniscus M.

Figure 11A:
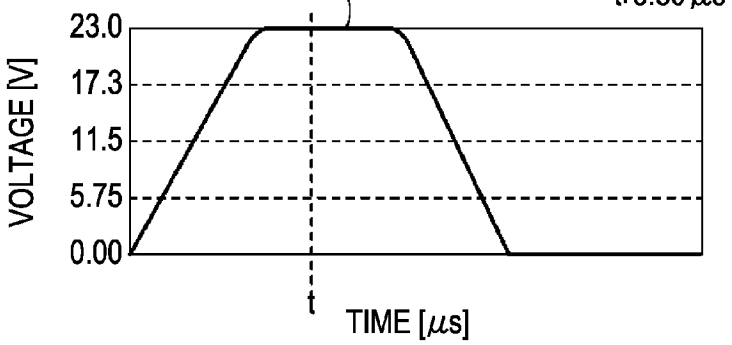
FIG. 11A is a view illustrating a voltage after the lapse of 3.80 μs from the discharge pulse application start timing.
Figure 11B:
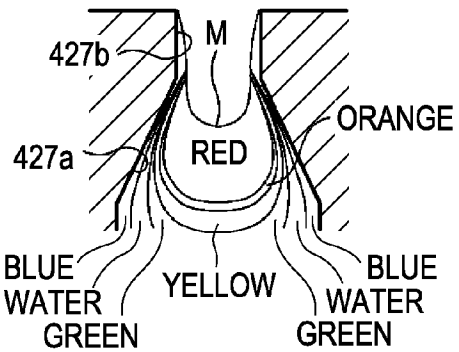
FIG. 11B is a view schematically illustrating the meniscus state and the pressure distribution in the timing of FIG. 11A.

As illustrated in FIGS. 11A and 11B, during the application period (3.80 μs) of the maintenance portion P2, the center portion of the meniscus M exceeds the straight portion 427*b*, and reaches to the tapered portion 427*a*. In this case, the red region having the highest pressure is distributed in the form of an elliptical sphere that is like the tip end portion of a matchstick in the tapered region 427*a*. Also, an orange region is distributed to cover the red region, and a yellow region is distributed to cover the orange region. In the same manner, other regions are distributed to cover their inner regions. In this state, since the orange region or the yellow region around the range in which the red region is distributed is thinly distributed, it can be recognized that a strong power for moving to the pressure chamber side 424 is still acting on the meniscus M.

Figure 12A:
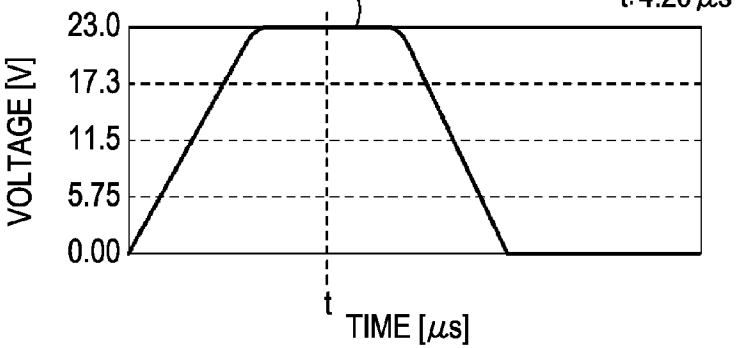
FIG. 12A is a view illustrating a voltage after the lapse of 4.20 μs from the discharge pulse application start timing.
Figure 12B:
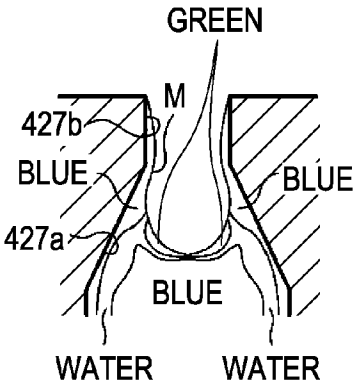
FIG. 12B is a view schematically illustrating the meniscus state and the pressure distribution in the timing of FIG. 12A.

As illustrated in FIGS. 12A and 12B, during the application period (e.g. 4.20 μs) of the maintenance portion P2, the center portion of the meniscus M is led to the middle portion of the tapered portion 427*a*. Around the meniscus M, a water region is mainly distributed, and a green region is shown in a portion thereof. The reason why a red region or an orange region having a high pressure do not exist is that energy is consumed by the leading of the meniscus M and thus a pressure difference becomes small. Accordingly, the meniscus M stops movement to the pressure chamber side 424, and then starts to move in the discharge direction. It is considered that the start of movement in the discharge direction is caused in the decompression of pressure chamber 424 by the ink inflow from the ink supply path 425 and the meniscus M returning to a normal state due to the surface tension.

Figure 13A:
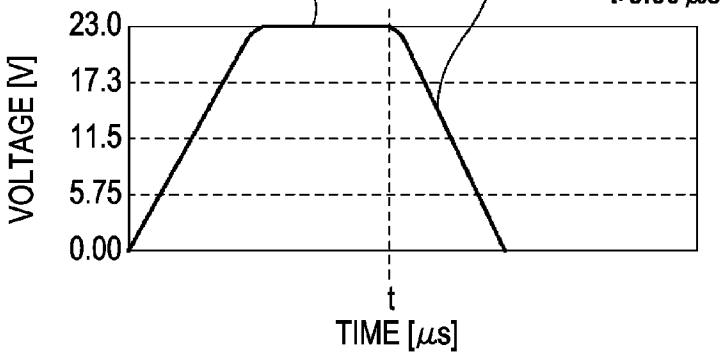
FIG. 13A is a view illustrating a voltage after the lapse of 5.60 μs from the discharge pulse application start timing.
Figure 13B:
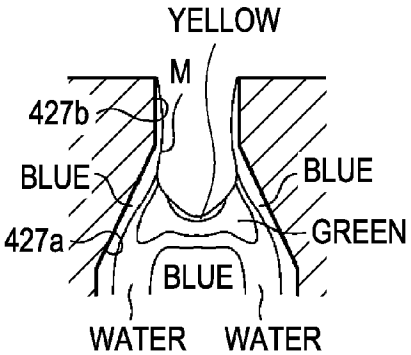
FIG. 13B is a view schematically illustrating the meniscus state and the pressure distribution in the timing of FIG. 13A.
Figure 14A:
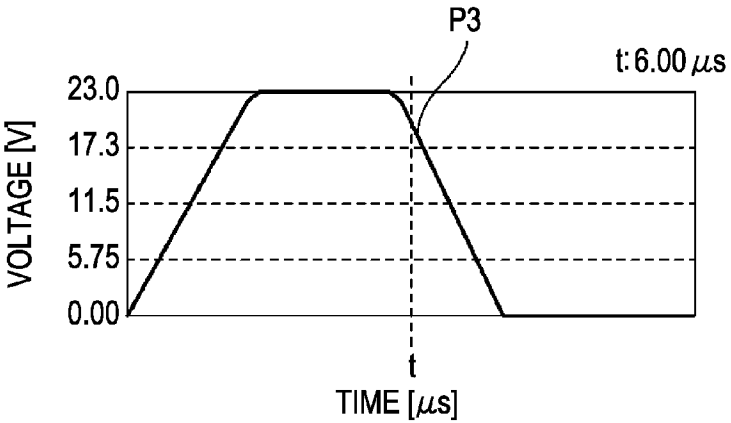
FIG. 14A is a view illustrating a voltage after the lapse of 6.00 μs from the discharge pulse application start timing.
Figure 14B:
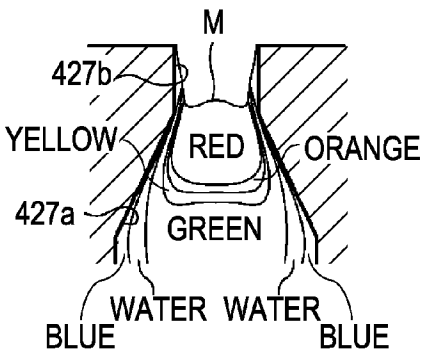
FIG. 14B is a view schematically illustrating the meniscus state and the pressure distribution in the timing of FIG. 14A.
Figure 15A:
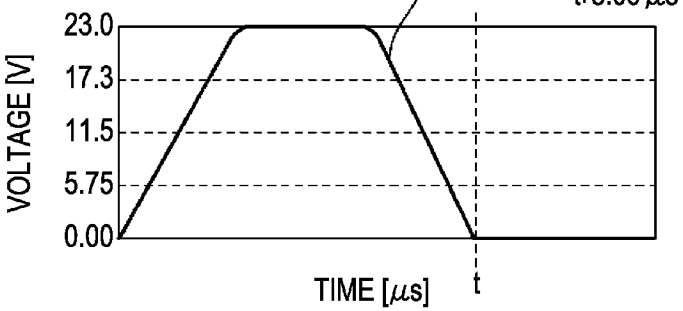
FIG. 15A is a view illustrating a voltage after the lapse of 8.00 μs from the discharge pulse application start timing.
Figure 15B:
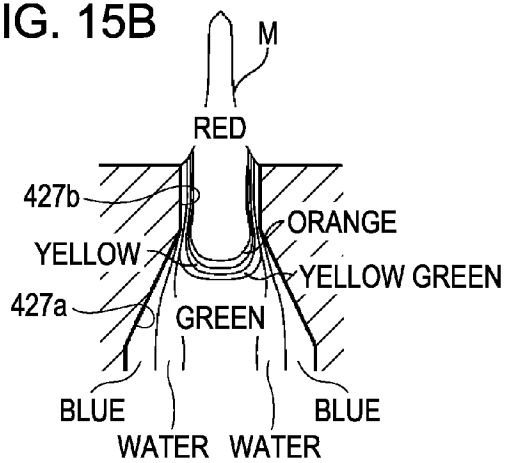
FIG. 15B is a view schematically illustrating the meniscus state and the pressure distribution in the timing of FIG. 15A.

As illustrated in FIGS. 13A and 13B, in the application start timing (e.g. 5.60 μs) of the compression portion P3, the center portion of the meniscus M is positioned in the neighborhood of the straight portion 427*b* (the end portion on the narrow side) of the tapered portion 427*a*. This timing corresponds to the timing before the meniscus M led to the tapered portion 427*a* returns to the straight portion 427*b*. As illustrated in FIGS. 14A and 14B, in the timing (e.g. 6.00 μs) just after the application start of the compression part P3, the center portion (bottom portion) of the meniscus M is positioned at the end portion on the pressure chamber side 424 of the straight portion 427*b*. This timing corresponds to the timing in which the meniscus M led to the tapered portion 427*a* returns to the straight portion 427*b*. Also, on the pressure chamber side 424, rather than the bottom portion of the meniscus M, a red region is distributed briefly in the form of a trapezoid. Also, an orange region is distributed to cover the red region, and a yellow region is distributed to cover the green region. In addition, on the outside of the yellow region, a green region is distributed. Here, the orange region and the yellow region are distributed in a narrow range. That is, isobars are distributed in a crowded state. This means that portions having high pressure are concentrated near the meniscus M. As illustrated in FIGS. 15A and 15B, in the application end timing (e.g. 8.00 μs) of the compression portion P3, a red region is distributed over the general ink portion existing in the straight portion 427*b* and a portion projecting to the outside from the nozzle 427. An orange region is distributed to cover the surroundings of the red region, a yellow region is distributed to cover the orange region, and a yellow green region is distributed to cover the yellow region. In the same manner as that as illustrated in FIG. 14B, the regions of the aforementioned are distributed in a narrow range. Accordingly, in the application end timing of the compression portion P3, the ink in the straight portion 427*b* of the nozzle 427 and the ink in the portion projecting from the nozzle 427 in a columnar form have a high pressure in comparison to the ink in other portions.

Here, the reason why the high-pressure portions are concentrated will be described. It is considered that this is caused by the action of the tapered portion 427*a*. That is, if an ink is compressed by contracting the pressure chamber 424, the power is also acting on the ink inside the nozzle 427. Upon reception of this force (i.e. the pushing pressure in the discharge direction), the ink moves along the tapered portion 427*a*. Since the tapered portion 427*a* tightens a flow path in which the ink flows, the force that is given to the ink becomes larger to concentrate the stress. Accordingly, portions having high pressure can be concentrated upon the boundary portions between the tapered portion 427*a* and the straight portion 427*b*. Also, the timing in which the ink is compressed is set to be just before the meniscus M led to the tapered portion 427*a* returns to the straight portion 427*b*. In other words, the ink is compressed in a state where the smallest amount of ink exists in the straight portion 427*b*. Accordingly, the compression force can be concentrated upon the ink existing at the end portion on the discharge side of the tapered portion 427*a*, and thus the ink can be locally and strongly compressed. This point also contributes to the concentration of the portions having high pressure. In this case, since the operation of the tapered portion 427*a* is used, it is preferable to determine the maximum leading degree of the meniscus M so that it does not exceed the tapered portion 427*a*.

Figure 16A:
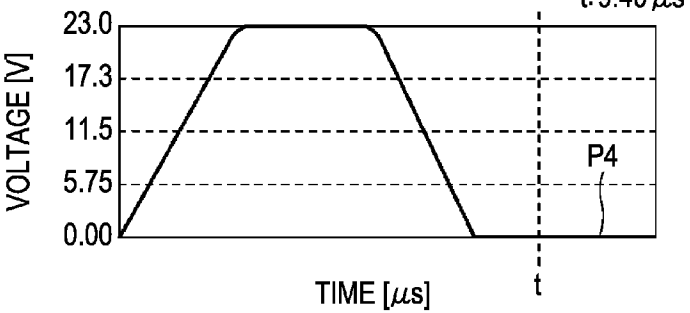
FIG. 16A is a view illustrating a voltage after the lapse of 9.40 μs from the discharge pulse application start timing.
Figure 16B:
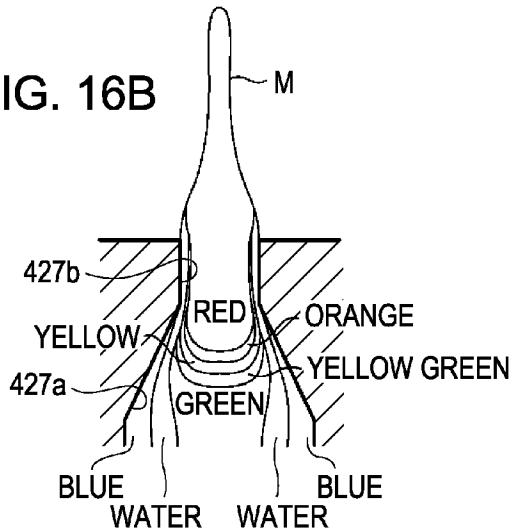
FIG. 16B is a view schematically illustrating the meniscus state and the pressure distribution in the timing of FIG. 16A.
Figure 17B:
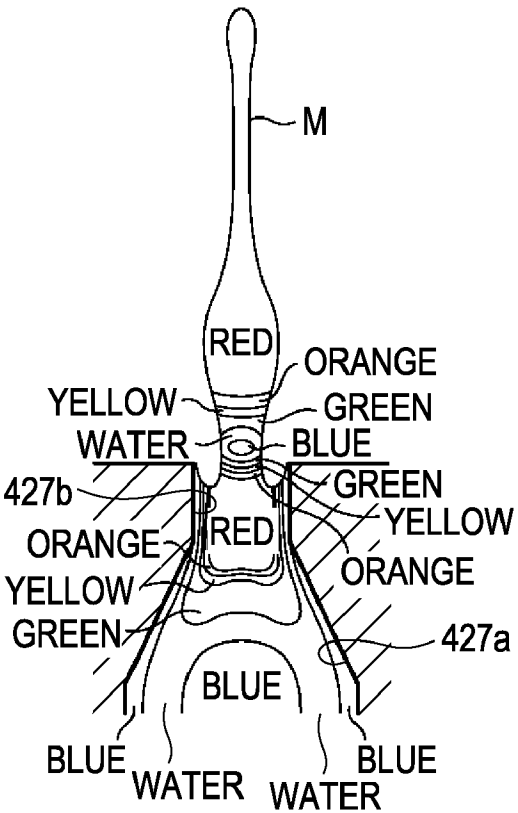
FIG. 17B is a view schematically illustrating the meniscus state and the pressure distribution in the timing of FIG. 17A.
Figure 17A:
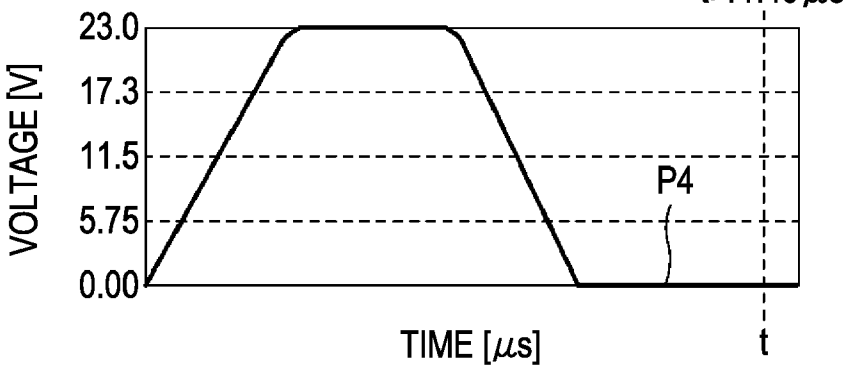
FIG. 17A is a view illustrating a voltage after the lapse of 11.40 μs from the discharge pulse application start timing.

As the result of performing the above-described control, as illustrated in FIGS. 16A and 16B, the pressure can be heightened with respect to the ink on the discharge side rather than the ink in the straight portion 427*b*, and thus an ink column, which moves at sufficient speed to discharge the ink drops, can be created. In addition, as illustrated in FIGS. 17A and 17B, a portion on the tip end portion of the ink column can be discharged as an ink drop. That is, a blue elliptical region exists in a slender portion of the ink column, and thus the ink column slips out of this portion. Also, a portion on the tip end side rather than the elliptical region is discharged as an ink drop. Since most of the portion that is discharged as the ink drop is the red region, it can be seen that the pressure change given to the ink inside the pressure chamber 424 is efficiently used to discharge the ink drops. Accordingly, a phenomenon that the tail portion of the ink drop is excessively lengthened can be suppressed. At that time, a portion on the pressure chamber side 424 rather than the elliptical region forms a new meniscus M.

Regarding a Taper Angle θ427

As described above, it is exemplified that the taper angle θ427 is 50 degrees. Since it is considered that the stress concentration occurs due to the movement of the ink in the tapered portion 427*a*, the taper angle θ427 has been examined. Here, evaluation has been made by setting the taper angle θ427 to 20, 25, 30, 40, 50, 60, and 80 degrees and discharging ink from nozzle 427 of each taper angle having the viscosity of 8, 10, 15, 20, 30, and 40 mPa·s, respectively. In this case, other data except for those exemplified here are the same as those as described above. In this evaluation, the nozzle 427 is formed so that the impedance Z427 of the nozzle 427 becomes smaller than the impedance Z425 of the ink supply path 425. Also, nozzles 427 having a taper angle θ427 that is equal to or larger than 80 degrees are excluded from the evaluation. This is because if the taper angle is equal to or larger than 80 degrees (e.g. if a tapered surface in an angle range that does not form an acute angle is installed), the ink flows along the tapered surface, and thus the pressure concentration effect is obtained. In this case, the maximum angle of the taper is determined by the width of the pressure chamber 424, the pitch of the nozzle 427, the length of the nozzle 427, and the like.

Figures 18, 19:
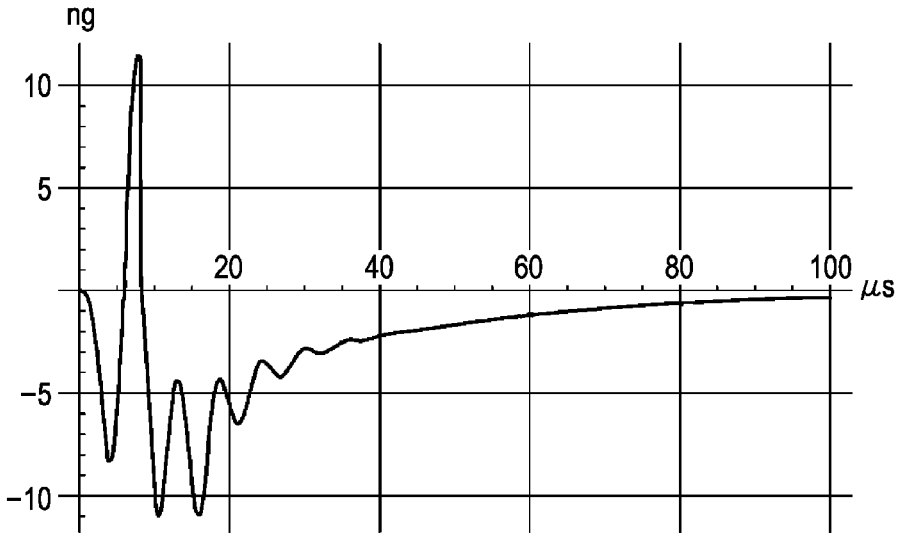
FIG. 18 is a view illustrating a list of evaluation results for taper angles.
FIG. 19 illustrates simulation data explaining a case in which the discharge becomes stable due to an impedance ratio of a nozzle to an ink supply path.

FIG. 18 is a view illustrating a list of the evaluation results. In the drawing, vertical items represent viscosities of ink and horizontal items represent taper angles θ427. Also, as the evaluation results, a mark "x" means that the ink is not in the form of a droplet, and thus is not discharged. Also, as the result of evaluation, "Δ" means that the tail portion occurring on the rear side in the flying direction of the ink drop has a length that may cause an obstacle in the printer 1. In this evaluation, if the tail portion is longer than 500 μm, the evaluation result becomes "Δ". Accordingly, symbol "○" indicates that the tail portion has a length to the extent that does not cause an obstacle in the printer 1.

The evaluation results reveal the followings. That is, there are relations between the taper angle θ427 and the ink viscosity, and it is preferable that as the ink has a higher viscosity, the taper angle θ427 is enlarged. This can be understood by perceiving the evaluation "x" in which the ink is unable to be discharged. For example, if the taper angle is 20 degrees, the ink has the viscosity of equal to or larger than 20 mPa·s, and the evaluation "x" is made. If the taper angle is 25 or 30 degrees, the ink has the viscosity of equal to or larger than 30 mPa·s, and the evaluation "x" is made. Also, if the taper angle is equal to or larger than 40 degrees and is equal to or smaller than 60 degrees, the ink has the viscosity of 40 mPa·s, and the evaluation "x" is made. Also, if the taper angle is equal to or larger than 80 degrees, the ink has the viscosity of 40 mPa·s, and the evaluation "Δ" is made.

In perceiving the evaluation "○", it can be known that there is an appropriate range of the taper angle θ427 in accordance with the viscosity of ink. For example, in the case of discharging the ink having the viscosity that is equal to or larger than 8 mPa·s and is equal to or smaller than 15 mPa·s, it can be known that the taper angle θ427 is equal to or larger than 40 degrees. Also, in the case of discharging the ink having the viscosity that is equal to or larger than 8 mPa·s and is equal to or smaller than 30 mPa·s, it can be known that the taper angle θ427 is equal to or larger than 50 degrees.

Next, the length L427*a* of the tapered portion 427*a* will be examined. In consideration of the working effect that the stress is concentrated upon the straight portion 427*b* of the tapered portion 427*a*, this working effect can be obtained if the tapered portion 427*a* is installed. Accordingly, the length may not be considered. Also, in order to discharge the high-viscosity ink more stably, it is preferable that the length L427*a* is equal to or larger than the straight portion 427*b* (has ½ of the length L427 of the nozzle 427). Also, in the above-described simulation, it is exemplified that the length L427 of the nozzle 427 is 100 μm, and 80 μm of the length L427 correspond to the length L427*a* of the tapered portion 427*a*. Accordingly, it is more preferable that the length L427*a* of the tapered portion 427*a* has ⅘ of the length L427 of the nozzle 427. By increasing the ratio of the tapered portion 427*a* to the length L427 of the nozzle 427, the high-pressure portion can be easily obtained.

Regarding Impedance

As described above, in the head HD used in the simulation, with respect to the ink having the viscosity of 30 mPa·s, the impedance Z427 of the nozzle 427 is $1.0\times10^{14}\Omega$, and the impedance Z425 of the ink supply path 425 is $1.27\times10^{14}\Omega$. That is, the impedance Z427 of the nozzle 427 is lower than the impedance Z425 of the ink supply path 425. Here, the impedance value is changed in accordance with the viscosity of the ink. Accordingly, if an ink having a different viscosity is used, the respective impedance values are changed. However, the relation in that the impedance Z427 of the nozzle 427 is lower than the impedance Z425 of the ink supply path 425 are met regardless of the viscosity of the ink.

If the impedance Z427 of the nozzle 427 is made to be lower than the impedance Z425 of the ink supply path 425, in the case where the pressure change is given to the ink inside the pressure chamber 424, it is difficult for the ink to pass through the ink supply path side 425 having a high impedance (acoustically heavy), and it is easy for the ink to pass through the nozzle 427 having a low impedance (acoustically light). Accordingly, the meniscus M can be efficiently moved according to the pressure change given to the ink. Also, the remaining oscillation, which occurs after the discharge of the ink drop (the pressure oscillation given to the ink inside the pressure chamber 424), is easy to remain in the pressure chamber 424, and thus the ink can easily flow from the common ink chamber 426 to the pressure chamber 424. Accordingly, the meniscus M can quickly return to a normal state, and the ink drops can be discharged at high frequency.

FIG. 19 is a view explaining this, and illustrates simulation data corresponding to FIG. 7. In acquiring the simulation data, the shape data of the nozzle 427 and the ink supply path 425 are as described above. That is, the impedance Z427 of the nozzle 427 is $1.0\times10^{14}\Omega$, and the impedance Z425 of the ink supply path 425 is $1.27\times10^{14}\Omega$. As illustrated in FIG. 19, the meniscus M returns to a position of almost a normal state at a time point in which 100 μs elapses from the application start of the discharge pulse PS. In the embodiment of the present invention, the fact that the meniscus M returns to the position of a normal state at a time point in which 100 μs elapses from the application start of the discharge pulse PS is considered as the basis of judging whether the ink drop can be stably discharged even at high frequency of about 40 kHz. Here, as the result as illustrated in FIG. 19, since the shortest discharge interval of the ink drops is 100 μs, it is considered that the maximum discharge frequency may be about 10 kHz. However, in the case of heightening the discharge frequency, ink drops are discharged one by one, and thus it is considered that the ink flows through an ink flow path (which is a series of flow paths from the common ink chamber 426 to the nozzle 427) to the nozzle side 427 from the common ink chamber side 426. This ink flow becomes faster as the discharge frequency is heightened, and thus it is considered that it supports the ink supply to the pressure chamber 424. As described above, the judgment basis has been set. If it is assumed that the ink drop that is equal to or more than 10 ng can be discharged at a frequency of about 40 kHz, the same performance as the printer that can discharge the existing aqueous ink can be displayed even if the high-viscosity ink is used.

In order to make the impedance Z427 of the nozzle 427 lowered, it is preferable to make the length L427*b* of the straight portion 427*b* shorter than the diameter ϕ427*b* thereof. By doing this, the level of inertia or the flow path resistance can be lowered. That is, since the level of inertia is obtained by multiplying the length L427*b* of the straight portion 427*b* by an ink density and dividing the result of multiplication by the opening area, the value of the level of inertia becomes smaller as the opening area becomes larger (e.g. as the diameter ϕ427*b* becomes larger). Also, the flow path resistance becomes lower as the length L427*b* of the straight portion 427*b* is shortened or the opening area becomes larger. Accordingly, making the length L427*b* of the straight portion 427*b* shorter than the diameter ϕ427*b* may be an efficient means for reducing the impedance Z427 of the nozzle 427.

Conclusion

From the foregoing, the following matters can be known. That is, the nozzle 427 has a tapered portion 427*a* (a first portion) in which the ink discharge side has an opening area that is determined to be smaller than that of the pressure chamber side 424, and a straight portion 427*b* (a second portion) that communicates with the end portion on the discharge side of the tapered portion 427*a*. The impedance Z427 of the nozzle 427 is determined to be lower than the impedance Z425 of the ink supply path 425 (liquid supply portion). Accordingly, the pressure oscillation that occurs in the ink inside the pressure chamber 424 can be efficiently transferred to the nozzle side 427, and thus the high-viscosity ink can be efficiently discharged.

Also, since the tapered portion 427*a* partitions a space in the shape of a circular truncated cone having a taper angle of equal to or larger than 40 degrees, it is possible to suppress that the tail portion of the ink drop is excessively lengthened. Also, since the tapered portion 427*a* is determined in an angle range according to the viscosity of the ink, the effect can be further heightened. The straight portion 427*b*, which communicates with the tapered portion 427*a*, has a cross-sectional area that is in the shape which is almost not changed on a surface that is orthogonal to a nozzle direction, and thus the flying direction of the discharged ink drop can be stabilized. In addition, since the length of the straight portion 427*b* (the length in the discharge direction) is shorter than the diameter ϕ427*b* of the straight portion 427*b* (the inside diameter of the opening), the pressure oscillation that is given to the ink inside the pressure chamber 424 can be efficiently transferred to the nozzle side 427.

Also, since the opening area Snzl on the discharge side of the nozzle 427 is determined to be equal to or smaller than 1/9 of the opening area Ssup on the pressure chamber side 424 of the ink supply path 425, the discharge rate of ink drops from the nozzle 427 is limited, and the supply rate of ink to the pressure chamber 424 can be secured. As a result, insufficient ink supply to the pressure chamber 424 can be solved, and thus the ink discharge can be stabilized.

Further, since the opening area Snzl of the nozzle 427 is determined to be equal to or larger than 1/20 of the opening area Ssup of the ink supply path 425, the ink flow can occur even on the nozzle side 427 when the ink is compressed in the pressure chamber 424, and thus the ink drops can be surely discharged.

In controlling the discharge using the discharge pulse PS, since the discharge pulse PS has the decompression portion P1 that decompresses the ink to lead the meniscus M positioned in the straight portion 427*b* to the tapered portion 427*a* and the compression portion P3 that compresses the ink to discharge the ink before the meniscus M which has been led to the tapered portion 427*a* returns to the straight portion 427*b*, the pressure that is given to the ink can be efficiently used to discharge the ink. In addition, since the maintenance portion P2 is created between the decompression portion P1 and the compression portion P3, the optimization of the timing can easily be performed.

Regarding Other Embodiments

In the above-described embodiments, a print system having the printer 1 as the liquid discharge apparatus has been described, and the disclosure of the liquid discharge method or the liquid discharge system is also included. Also, the disclosure of the liquid discharge head or the method of controlling the liquid discharge head is also included. The foregoing embodiments are for easy understanding of the invention, and are not to be construed as limiting the present invention. The present invention can be modified or improved without departing from the scope of the invention, and includes the equivalents thereof. In particular, even the embodiment described hereinafter is included in the present invention.

Regarding the Shape of a Nozzle 427

Figure 20A:
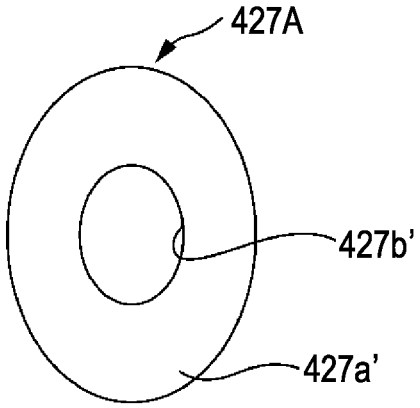
FIG. 20A is a view illustrating a first modified example of a nozzle.
Figure 20B:
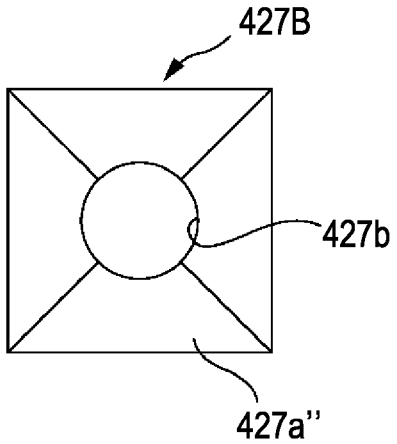
FIG. 20B is a view illustrating a second modified example of a nozzle.
Figure 20C:
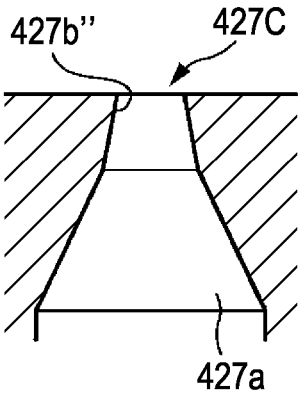
FIG. 20C is a view illustrating a third modified example of a nozzle.

In the above-described embodiments, the nozzle 427 has the tapered portion 427*a* that partitions the space (flow path) in the shape of a circular truncated cone, and the straight portion 427*b* that partitions the space in the shape of a cylinder. However, the shape of the nozzle 427 is not limited thereto. It is enough that the liquid discharge side has the opening area that is smaller than that of the pressure chamber side 424. For example, as shown in FIG. 20A illustrating a nozzle 427A, the tapered portion 427*a*' and the straight portion 427*b*' may be modified to an elliptical shape. Also, as shown in FIG. 20B illustrating a nozzle 427B, a square pyramid portion 427*a*" may be installed instead of the tapered portion 427*a*. These nozzles 427A and 427B have the same working effect. Also, as shown in FIG. 20C illustrating a nozzle 427C, a first tapered portion 427*a* on the pressure chamber side 424 and a second tapered portion 427*b*" on the discharge side may be formed. In the nozzle 427C, the second tapered portion 427*b*" corresponds to a portion that partitions the space in the shape of another circular truncated cone which has a smaller taper angle than that of the portion in the shape of the circular truncated cone that partitions the first tapered portion 427*a*. In the nozzle 427C, the flying speed of the ink drop can be heightened.

Regarding a Device Performing a Discharge Operation

In the printer 1, as the device that performs an operation for discharging the ink, the piezoelectric device 433 is used. Here, the device that performs the discharge operation is not limited to the piezoelectric device 433. It is enough that the device operates to give the pressure change to the liquid in the pressure chamber 424 in accordance with the applied electric potential. For example, the device may be a magnetostrictive device. In the case of using the piezoelectric device 433 as in the above-described embodiments, the capacity of the pressure chamber 424 can be accurately controlled based on the voltage of the discharge pulse PS. That is, the pressure that is given to the ink inside the pressure chamber 424 can be minutely controlled.

Regarding Other Applications

Also, in the above-described embodiments, it is exemplified that the liquid discharge apparatus is, but is not limited to, the printer 1. For example, the same technology as the embodiments of the present invention can be applied to various kinds of liquid discharge apparatuses applying ink jet technology, such as a color filter manufacturing apparatus, a dyeing apparatus, a minute processing apparatus, a semiconductor manufacturing apparatus, a surface processing apparatus, a three-dimensional molding machine, a liquid gasifying apparatus, an organic EL manufacturing apparatus (especially a high polymer EL manufacturing apparatus), a display manufacturing apparatus, a film forming apparatus, a DNA chip manufacturing apparatus, and the like. Also, their methods and manufacturing methods are under the category of their application ranges.

What is claimed is:

1. A liquid discharge apparatus comprising:

a nozzle from which liquid is discharged;

a pressure chamber that gives a pressure change to the liquid in order to discharge the liquid from the nozzle;

a liquid supply portion that communicates with the pressure chamber and supplies the liquid to the pressure chamber, wherein impedance of the nozzle is lower than that of the liquid supply portion;

a device that performs an operation for giving the pressure change to the liquid in the pressure chamber; and a discharge pulse generating unit that generates a discharge pulse for operating the device in order to discharge the liquid from the nozzle;

wherein a viscosity of the liquid is equal to or higher than 8 millipascal seconds;

the nozzle has a first portion of which a liquid discharge side has an opening area that is smaller than that of a pressure chamber side, and a second portion that communicates with an end portion of the discharge side of the first portion;

an opening area of the end of the discharge side of the second portion is equal to or smaller than 1/9 of the opening area of the pressure chamber side as an opening of the liquid supply portion; and the discharge pulse has a decompression portion that decompresses the liquid to lead a meniscus positioned in the second portion to the first portion, and a compression portion that compresses the liquid to discharge the liquid before the meniscus which has been led to the first portion returns to the second portion.

2. The liquid discharge apparatus according to claim 1, wherein the opening area of the discharge-side end portion of the second portion is equal to or larger than 1/20 of the opening area on the pressure chamber side.

3. The liquid discharge apparatus according to claim 1, wherein the discharge pulse has a maintenance portion that maintains the state of the device in the generation end timing of the decompression portion over a period from the end of generation of the decompression portion to the start of application of the compression portion.

4. The liquid discharge apparatus according to claim 1, wherein the first portion of the nozzle partitions a space in the shape of a circular truncated cone having a taper angle of equal to or larger than 40 degrees.

5. The liquid discharge apparatus according to claim 1, wherein the second portion of the nozzle has a cross-sectional area in the shape which is almost unchanged on a surface that is orthogonal to a nozzle direction.

6. The liquid discharge apparatus according to claim 1, wherein the device is a piezoelectric device which gives a pressure change to the liquid by changing a capacity of the pressure chamber through deformation in accordance with an electric potential of the applied discharge pulse.

7. The liquid discharge apparatus according to claim 6, wherein the degree of capacity change of the pressure chamber per unit time by the compression portion is set to be higher than the degree of capacity change of the pressure chamber per unit time by the decompression portion, and the discharge pulse does not have a portion for suppressing movement of the meniscus in the discharge of the liquid, following the compression portion.

8. A liquid discharge method for discharging liquid having viscosity that is equal to or higher than 8 millipascal seconds from a nozzle using a liquid discharge apparatus including;

the nozzle from which liquid is discharged;

a pressure chamber that gives a pressure change to the liquid in order to discharge the liquid from the nozzle;

a liquid supply portion that communicates with the pressure chamber and supplies the liquid to the pressure chamber; and a device that performs an operation for giving the pressure change to the liquid in the pressure chamber;

wherein the nozzle has a first portion of which a liquid discharge side has an opening area that is smaller than that of a pressure chamber side and a second portion that communicates with an end portion of the discharge side of the first portion; and an opening area of the discharge side portion of the second portion is equal to or smaller than 1/9 of the opening area on the pressure chamber side as an opening of the liquid supply portion;

the liquid discharge method comprising the steps of:

decompressing the liquid to lead a meniscus positioned in the second portion to the first portion; and compressing the liquid to discharge the liquid before the meniscus which has been led to the first portion returns to the second portion, wherein impedance of the nozzle is lower than that of the liquid supply portion.

* * * * *